US008286390B2

(12) United States Patent
Leahy

(10) Patent No.: US 8,286,390 B2
(45) Date of Patent: Oct. 16, 2012

(54) REMOVABLE DOWNSPOUT FOR A GUTTER SYSTEM

(76) Inventor: Kevin N. Leahy, Wayne, PA (US)

( * ) Notice: Subject to any disclaimer, the term of this patent is extended or adjusted under 35 U.S.C. 154(b) by 308 days.

(21) Appl. No.: 12/451,265

(22) PCT Filed: May 6, 2008

(86) PCT No.: PCT/US2008/005784

§ 371 (c)(1),
(2), (4) Date: Nov. 3, 2009

(87) PCT Pub. No.: WO2008/137145

PCT Pub. Date: Nov. 13, 2008

(65) Prior Publication Data

US 2010/0126078 A1 May 27, 2010

Related U.S. Application Data

(60) Provisional application No. 60/928,032, filed on May 7, 2007.

(51) Int. Cl.
*E04D 13/08* (2006.01)

(52) U.S. Cl. ..... 52/16; 52/11; 52/302.1; 52/302.3

(58) Field of Classification Search ..... 52/11, 16, 52/169.5, 302.1, 302.3, 302.5; 138/119
See application file for complete search history.

(56) References Cited

U.S. PATENT DOCUMENTS 3,821,890 A * 7/1974 Dewey ..... 72/325
3,994,055 A * 11/1976 Maloney et al. ..... 29/890.14
4,134,002 A * 1/1979 Stanford ..... 219/213
4,285,812 A * 8/1981 Stoltz ..... 210/162
4,632,342 A * 12/1986 Skinner ..... 248/48.2
4,741,645 A * 5/1988 Butler ..... 405/118
4,745,709 A * 5/1988 Johnson ..... 52/2.26
4,798,028 A * 1/1989 Pinion ..... 52/16

(Continued)

FOREIGN PATENT DOCUMENTS

JP 09228592 9/1997

(Continued)

OTHER PUBLICATIONS

Brochure for "Tilt 'N Clean® Rain Gutter Systems" (Feb. 2002).

(Continued)

*Primary Examiner* — Brian Glessner
*Assistant Examiner* — Joshua Ihezie
(74) *Attorney, Agent, or Firm* — Gary M. Cohen

(57) ABSTRACT

A removable downspout system for use with conventional gutter systems includes a spout mated with a gutter of the gutter system, a box mated with a downspout for the gutter system, and components for removably mating the downspout fitted with the box to the gutter fitted with the spout. The spout and the box mate with one another, as nested structures, to prevent leakage at the junction between the spout and the box. A base is provided for attaching the downspout to the receiving structure, and a clip cooperates with the base for removably retaining the downspout to the base. As an alternative, a support structure is provided for mating the downspout with an underground system of pipe, and is fitted over the entrance to the underground system of pipe. A clamp is also provided for attaching the downspout to the receiving structure, in cooperation with a clip for removably retaining the downspout to the clamp.

68 Claims, 18 Drawing Sheets

U.S. PATENT DOCUMENTS

| | | | | |
|---|---|---|---|---|
| 4,837,987 | A * | 6/1989 | Fender | 52/11 |
| 4,951,430 | A | 8/1990 | Gottlieb | |
| 4,956,948 | A * | 9/1990 | Hart | 52/16 |
| 5,146,718 | A * | 9/1992 | Baskett | 52/11 |
| 5,160,811 | A * | 11/1992 | Ritzmann | 174/68.3 |
| 5,170,596 | A * | 12/1992 | Zadok et al. | 52/16 |
| 5,184,435 | A * | 2/1993 | Sherman | 52/12 |
| 5,317,843 | A * | 6/1994 | Sheehan | 52/11 |
| 5,357,719 | A * | 10/1994 | Lewis | 52/11 |
| 5,406,756 | A * | 4/1995 | Bemis et al. | 52/16 |
| 5,406,966 | A * | 4/1995 | Lepkowski et al. | 134/104.4 |
| 5,437,138 | A * | 8/1995 | Tuohey et al. | 52/741.1 |
| 5,522,427 | A * | 6/1996 | Johnson | 137/616.5 |
| 5,526,611 | A | 6/1996 | Leahy | |
| 5,619,825 | A * | 4/1997 | Leroney et al. | 52/12 |
| 5,709,051 | A * | 1/1998 | Mazziotti | 52/12 |
| 5,718,085 | A * | 2/1998 | Plum | 52/11 |
| 5,794,384 | A * | 8/1998 | Dean et al. | 52/16 |
| 5,867,943 | A * | 2/1999 | Thomas | 52/11 |
| 5,882,508 | A * | 3/1999 | St-Jacques | 210/87 |
| 5,893,239 | A | 4/1999 | Leahy | |
| 5,985,158 | A | 11/1999 | Tiderington | |
| 6,012,682 | A * | 1/2000 | Tredennick | 248/48.1 |
| 6,240,679 | B1 * | 6/2001 | Smalara | 52/16 |
| 6,263,618 | B1 * | 7/2001 | Jones | 52/12 |
| 6,334,953 | B1 * | 1/2002 | Singleton | 210/232 |
| 6,397,526 | B1 * | 6/2002 | Saul et al. | 52/16 |
| 6,701,675 | B1 * | 3/2004 | Ekker et al. | 52/16 |
| 6,739,800 | B2 * | 5/2004 | Bevilacqua | 405/48 |
| 7,017,614 | B2 * | 3/2006 | Handley | 138/109 |
| 7,065,924 | B2 * | 6/2006 | Wade | 52/16 |
| 2004/0040219 | A1 * | 3/2004 | Bacik et al. | 52/11 |
| 2005/0155660 | A1 * | 7/2005 | Handley | 138/109 |
| 2005/0160681 | A1 * | 7/2005 | Boelling | 52/16 |
| 2005/0257433 | A1 * | 11/2005 | Dussault et al. | 52/12 |
| 2006/0016129 | A1 * | 1/2006 | Riese | 52/16 |
| 2007/0046021 | A1 * | 3/2007 | Crawford | 285/226 |
| 2008/0023959 | A1 * | 1/2008 | Crawford | 285/226 |
| 2008/0128030 | A1 * | 6/2008 | Lewis | 137/265 |
| 2008/0138156 | A1 * | 6/2008 | Janesky | 405/40 |
| 2009/0229192 | A1 * | 9/2009 | McNeish et al. | 52/16 |

FOREIGN PATENT DOCUMENTS

| | | |
|---|---|---|
| KR | 198910803 | 7/1989 |
| KR | 198923083 | 12/1989 |
| KR | 199816228 | 6/1998 |

OTHER PUBLICATIONS

Brochure for "The SpoutOff" (Feb. 2007).

Brochure for "The SpoutOff—Parts and Installation" (Sep. 2008).

* cited by examiner

REMOVABLE DOWNSPOUT FOR A GUTTER SYSTEM

CROSS-REFERENCE TO RELATED APPLICATION

This application claims the benefit of U.S. Provisional Application No. 60/928,032, filed May 7, 2007.

BACKGROUND OF THE INVENTION

The present invention generally relates to gutter systems used on structures for directing water resulting from precipitation away from the structure which receives the gutter system, and more particularly, to an improved arrangement for mating the downspout associated with the gutter system with the remainder of the system.

Any of a number of different structures are routinely provided with any of a variety of different gutter systems for accommodating water resulting from various weather conditions such as rain, snow and sleet. Such gutter systems conventionally operate to receive water which has come to be collecting on roof portions of the structure which receives the gutter system, and to channel that water down one or more substantially horizontal gutters fitted along the perimeter of the roof (i.e., the fascia) and into one or more generally vertical downspouts for bringing the collected water down to ground level. Bottom portions of the downspout can conventionally be provided with a curved or angled piece, known as a "shoe", for directing the water away from the structure, or an underground system of pipe for directing the water away from the structure, in either case, for purposes of preventing water damage to the structure.

Because such gutter systems are designed to effectively catch water, it is common for such gutter systems to also retain other, unwanted debris such as leaves, twigs, nests, balls, etc. Debris collecting along the bottom of the gutters of the gutter system does not necessarily cause a problem because water will tend to follow the path of least resistance, and will tend to flow under, around and/or over the collected debris. However, when debris moves down the gutters, toward the downspouts, there is a tendency for such debris to clog the holes where the gutters meet the downspouts, and this clogging can cause problems. For example, because water cannot then freely exit the gutter and flow down the downspout, water tends to back up and overflow the gutter, rendering the gutter useless. This can also provide a breeding area for insects, and can even produce enough weight to pull the gutter from the structure which receives it.

As a consequence, it is important to ensure that the area where the gutter meets the downspout is kept clean and free of debris to ensure that water will be able to effectively flow from the gutter and into the downspout, for desired discharge from the gutter system. Often, this is done manually, requiring someone to climb up to the gutters, or the roof of the structure, to inspect and/or clean the gutters and their junctions with the downspouts. This can, however, present certain dangers, and this is generally not done by most on an effective and regular basis. For this reason, a number of systems have been developed in an effort to reduce the amount of debris that can collect in the gutters of a gutter system.

For example, screens, covers, so-called "helmets", and the like, have been installed on the gutters to prevent debris, birds, bees, etc., from entering and collecting in the gutters. Even taking such measures, however, debris, nests, hives, etc., still tend to find their way into the gutters and to eventually clog the area where the gutters meet the downspouts. This is particularly so when considering that it does not take a lot of debris to clog the top opening of a downspout. Also, because covered gutters cannot easily be inspected, it is not uncommon to remain unaware of a potential problem until the problem manifests itself, and damage has been done.

Another solution which has been attempted is to provide the top opening of the downspout with a screen directly fitted to the junction between the gutter and the downspout. In practice, however, this attempted solution has actually been found to be counter-productive because even a small amount of debris that encounters the screen will tend to immediately begin to clog the screen, with the result that the screen will then itself operate to prevent other debris from entering the downspout.

Another solution which has been attempted is to enlarge the opening where the gutter meets the downspout. In practice, however, this attempted solution has also been found to be counter-productive because larger debris such as twigs, balls and nests tend to fall through the larger opening and get stuck in the downspout, or the connecting elbow, leading to the further potential for clogging.

Recognizing that attempts to reduce the amount of debris that can collect in the gutters was not providing an entirely satisfactory solution, U.S. Pat. No. 5,526,611 (Leahy) and U.S. Pat. No. 5,893,239 (Leahy) disclosed a different approach toward keeping the gutters of a gutter system clean. To this end, a gutter system (marketed under the trademark "Tilt 'N Clean") was provided which allowed a user to rotate the gutters from a conventional, water-catching position, through an angle of 110 degrees, to a debris-dumping position. Moreover, this could be done while the user was at ground level. Such rotation of the gutters enabled debris to fall out of the gutters, in this way helping to reduce the amount of debris that could reach the opening for the downspout. At times, however, the downspout could still become clogged where the gutter met the downspout.

To overcome this problem, the Tilt 'N Clean system was provided with downspouts that could be removed from the gutters, enabling the user to remove the downspout from the structure. Debris in the downspout, primarily at the top of the downspout, could then be cleaned out by the user while remaining on the ground. This downspout system, however, was specific to the Tilt 'N Clean system and could not be used on any other gutter systems because the resulting interface would tend to leak.

As a consequence, while the Tilt 'N Clean system could be adapted to allow a 1, 2 or 3-story downspout to be removed from the gutter which receives it, so the downspout could then be cleaned while on the ground and as often as needed, the majority of the gutter systems currently in operation (on the order of 95%) are the so-called "K-style" gutters (e.g., 5 inch K-gutters), and the removable downspouts of the Tilt 'N Clean system could not be adapted to such gutters. It therefore remained to develop a removable downspout system that could be effectively used with the more conventional gutter systems currently in use.

SUMMARY OF THE INVENTION

In accordance with the present invention, a removable downspout system is provided which is capable of use with any of a variety of conventional gutter systems currently in use, and which is generally comprised of a mated pair of water-collecting structures, one of which (hereafter referred to as a "spout") is configured for being mated with a gutter and the other of which (hereafter referred to as a "box") is configured for being mated with a downspout, and a system of components for removably mating the downspout fitted with the box to the structure which receives the gutter system, and to the gutter fitted with the spout.

The spout and the box are preferably configured to closely mate with one another, as nested structures, and are preferably combined so that the spout is to the extent possible fully received within the box. This then operates to prevent leakage at the junction between the spout and the box to the extent possible.

The system of components for removably mating the downspout fitted with the box to the structure which receives the gutter system and to the gutter fitted with the spout can include a base for attachment to the structure which is to receive the downspout, and a clip which cooperates with the base for removably retaining the downspout to the base. The base preferably provides vertical support for the downspout received by the base, to prevent unwanted separation of the box from the spout, as well as unwanted separation of the downspout from the gutter, and is used to secure the downspout to the structure.

As an alternative, the system of components for removably mating the downspout fitted with the box to the structure which receives the gutter system and to the gutter fitted with the spout can be mated with an underground system of pipe for directing water away from the structure. To this end, a support structure is fitted over the entrance to the underground system of pipe and the downspout is received by and supported in position by the support structure. The support structure preferably provides vertical support for the downspout to prevent unwanted separation of the box from the spout, as well as unwanted separation of the downspout from the gutter.

Additional downspout supporting structures are provided which can be fitted to the structure which receives the downspout and which can be mated with a retaining clip similar to the clip used to removably connect the downspout to the base, primarily for use with longer downspouts requiring additional support.

Further discussion of the removable downspout system of the present invention is available with reference to the detailed description of preferred embodiments which is provided hereafter, together with the following illustrations.

DETAILED DESCRIPTION OF PREFERRED EMBODIMENTS

Figure 1:
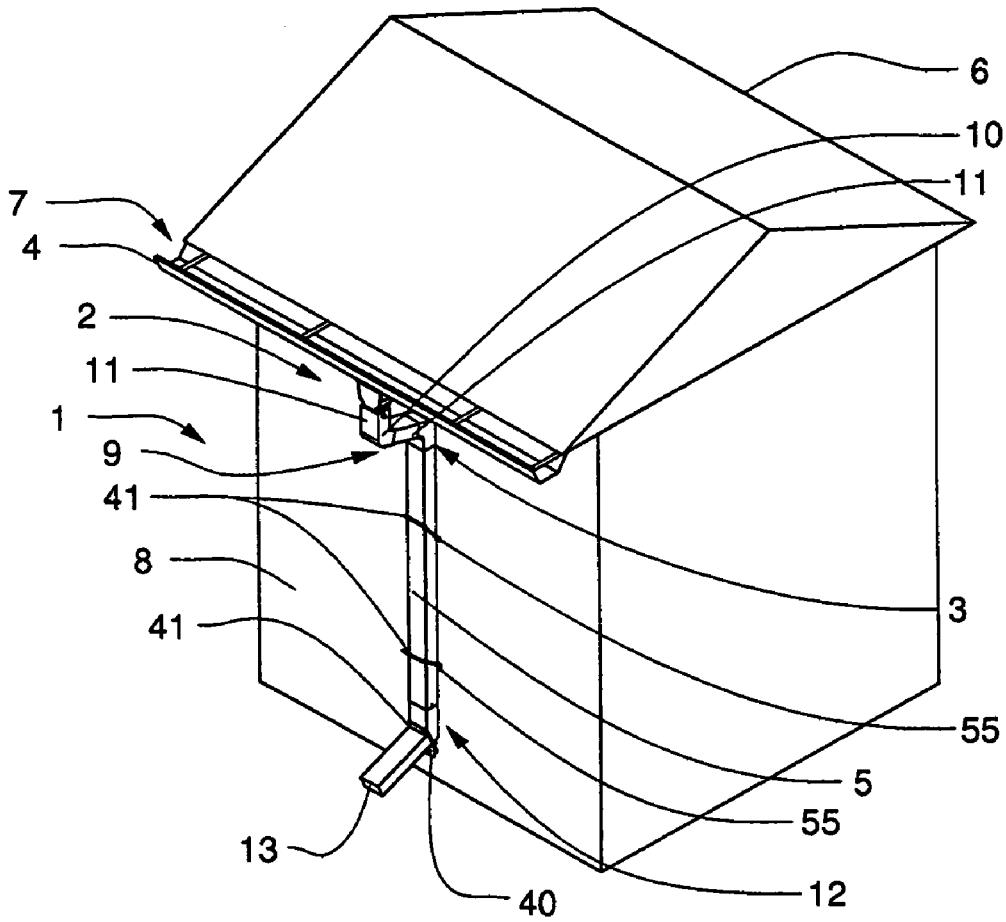
FIG. 1 is a schematic, isometric view showing the removable downspout system of the present invention mated to a structure.

FIG. 1 schematically illustrates a structure 1 having a gutter system 2 which incorporates a removable downspout system 3 produced in accordance with the present invention. It is to be understood that the structure 1 can, in practice, constitute any of a variety of different structures, including residential and commercial structures, and that the structure 1 shown in FIG. 1 has been provided only for purposes of illustration.

The gutter system 2, shown mated with the structure 1, can also be implemented using any of a variety of conventional gutter types, including but not limited to K-gutters, half-round gutters and box gutters, combined with any of a variety of conventional downspout types, including but not limited to rectangular and round, boxed downspout configurations.

Consequently, although the gutter system 2 which has been selected for illustration in the drawings, and which is referred to in the description which follows, is primarily based on a combination of the more conventional K-type gutters, mated with boxed rectangular downspouts, it is to be understood that the gutter system 2 can employ other types of components, in configurations other than those which have been specifically described and illustrated.

In the illustrative example shown in FIG. 1, the gutter system 2 includes a gutter 4 mated with a removable downspout 5. It is to be understood that for most applications, a plurality of gutter segments and downspouts will be employed to effectively drain water from the roof 6 of the structure 1, and that the single gutter and downspout illustrated in FIG. 1 has been shown for convenience of description only.

The gutter 4 is attached to the fascia 7 of the structure 1, adjacent to the roof 6 of the structure 1, for purposes of receiving water collected on the roof 6. This can be accomplished using conventional techniques which are in and of themselves known.

The downspout 5 is attached to a wall 8 of the structure 1, using techniques which will be described more fully below, and communicates with the gutter 4 for purposes of receiving water from the gutter 4, for discharge from the bottom of the downspout 5.

In the configuration shown, upper portions 9 of the downspout 5 are offset from the gutter 4, using an extension 10 combined with a mated pair of elbows 11, to accommodate the overhang of the roof 6. For appropriate configurations, a straight downspout can also be used at this interface, and the extension 10 and elbows 11 can be eliminated. Lower portions 12 of the downspout 5 are provided with a shoe 13 for directing water discharged from the downspout 5 away from the structure 1. As will be discussed more fully below, the shoe 13 can also be eliminated for downspouts which are to discharge water directly into an underground system of pipe for directing water discharged from the downspout 5 away from the structure 1, if desired.

Figure 2:
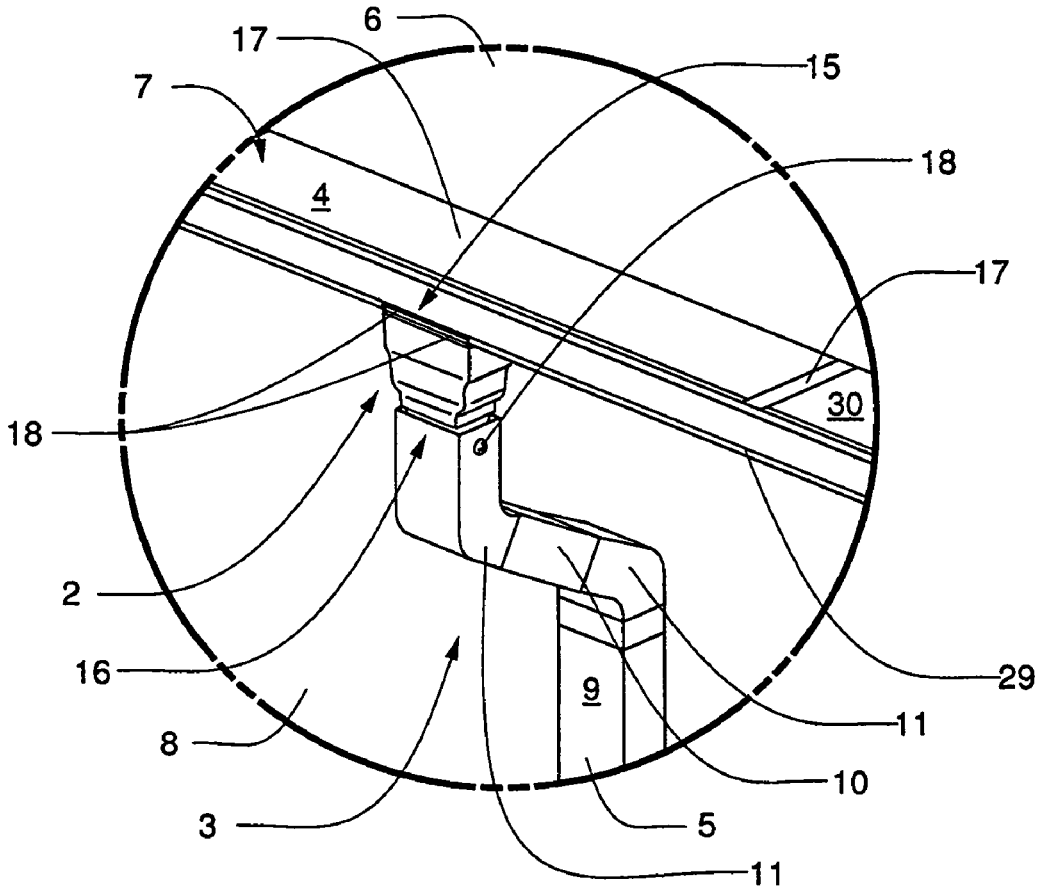
FIGS. 2 and 3 are enlarged, isometric views showing upper portions of the removable downspout mated to the gutter fixed to the structure, from different perspectives.
Figure 3:
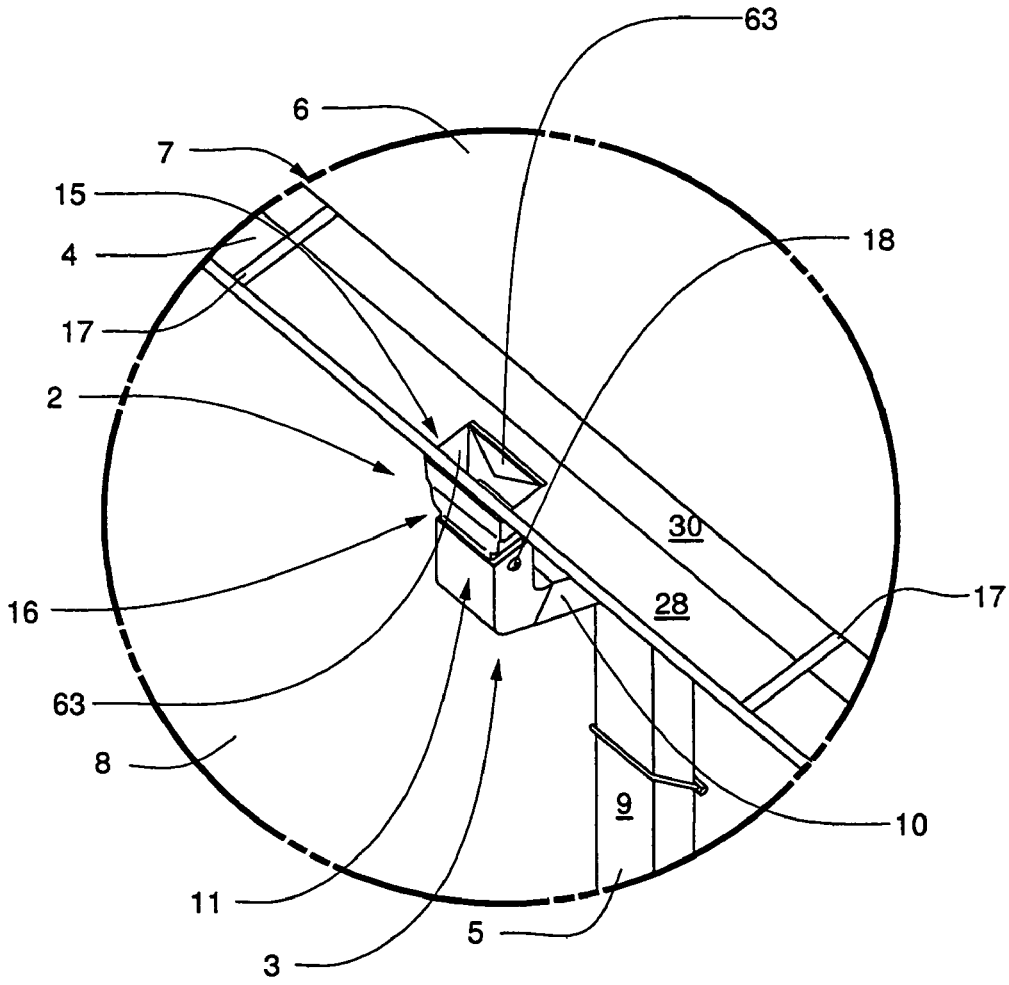

Referring to FIGS. 2 and 3, and in accordance with the present invention, the downspout 5 is coupled with the gutter 4 by a cooperating combination of a spout 15 associated with the gutter 4 and a box 16 associated with the downspout 5. In the configuration shown, the spout 15 is mated with a conventional, K-type gutter 4 (e.g., a 5 inch K-type gutter), which is in turn mounted to the fascia 7 of the structure 1 using conventional fasteners 17. The box 16 is mated with one of the elbows 11 associated with the extension 10, which are in turn mated with a conventional, rectangular downspout (e.g., a 2×3 or a 3×4 inch downspout) using, for example, the zip screws 18 shown in FIGS. 2 and 3, or other desired fasteners.

Figure 4:
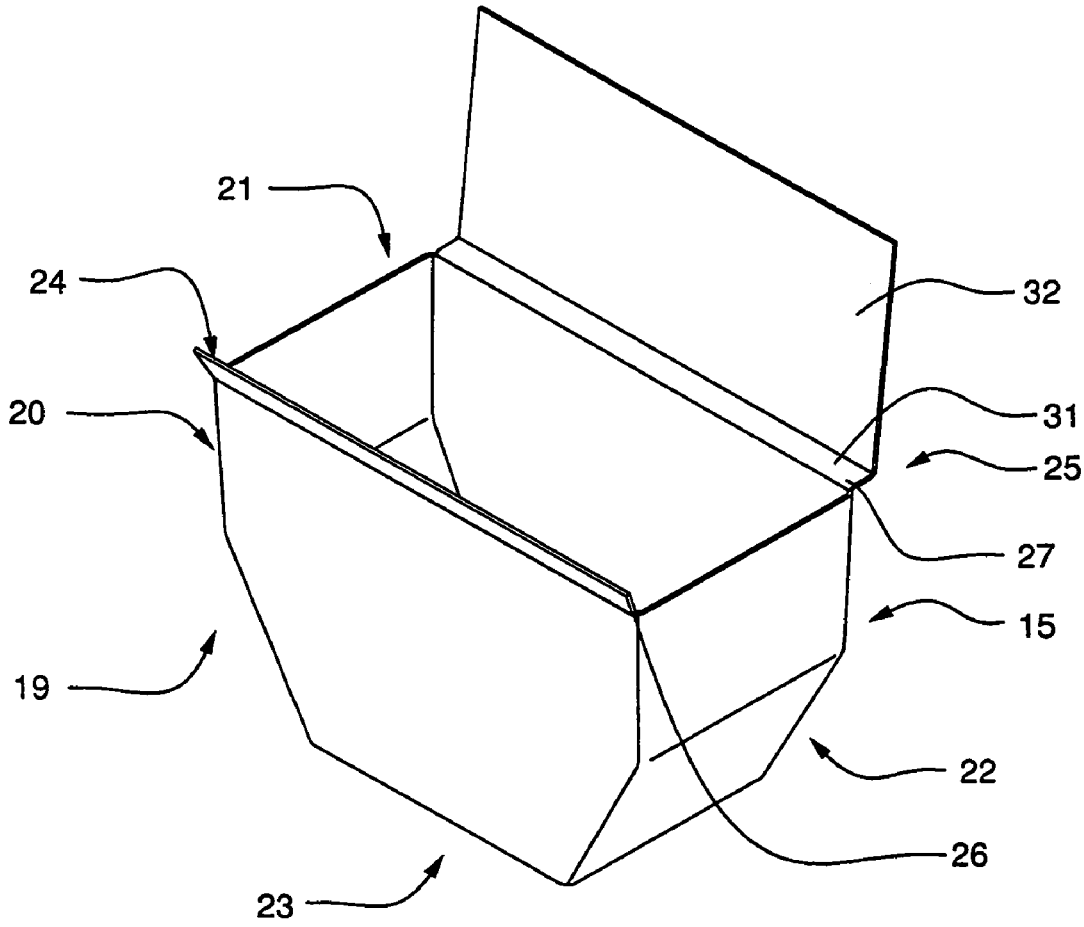
FIG. 4 is an enlarged, isometric view showing the spout of the removable downspout system.

FIG. 4 shows a preferred embodiment of the spout 15, separate from the gutter 4 which receives it. The body 19 of the spout 15 includes upper portions 20 which define an opening 21 for communicating with the gutter 4, as will be described more fully below, and which are substantially rectangular in overall cross-section. Lower portions 22 of the spout 15 communicate with the upper portions 20, and are provided with an inwardly disposed taper, forming an inverted, truncated generally pyramid shaped section which defines an opening 23 for communicating with the downspout 5, as will be described more fully below. The upper portions 20 and the lower portions 22 of the body 19 of the spout 15 are preferably formed as an integral structure, but can be formed as separate, connected structures, if desired.

A pair of flanges 24, 25 extend from an opposing front edge 26 and back edge 27 of the opening 21 formed in the upper portions 20 of the spout 15. The opening 21 has a width which substantially corresponds to the width of the bottom 28 (see, FIG. 3) of the gutter 4 which is to receive the spout 15. The flange 24 extends from the front edge 26, and projects outwardly for engaging lower side wall portions 29 (see, FIG. 2) of the gutter 4 which extend upwardly from the bottom 28. The flange 24 is conveniently secured to the side wall portions 29 of the gutter 4 using, for example, zip screws 18, or some other desired fastener, as will be described more fully below.

The flange 25 extends from the rear edge 27, and includes a first, substantially horizontal section 31 which projects outwardly, away from the rear edge 27, and a second, substantially vertical section 32. The vertical section 32 is extended, relative to the flange 24, and is provided for placement between the rear side wall 30 of the gutter 4 and the fascia 7 of the roof 6, as will be described more fully below, for purposes of securing the spout 15 to the gutter 4 and the fascia 7, and to allow the box 16 to fit up behind the spout 15.

Figure 5:
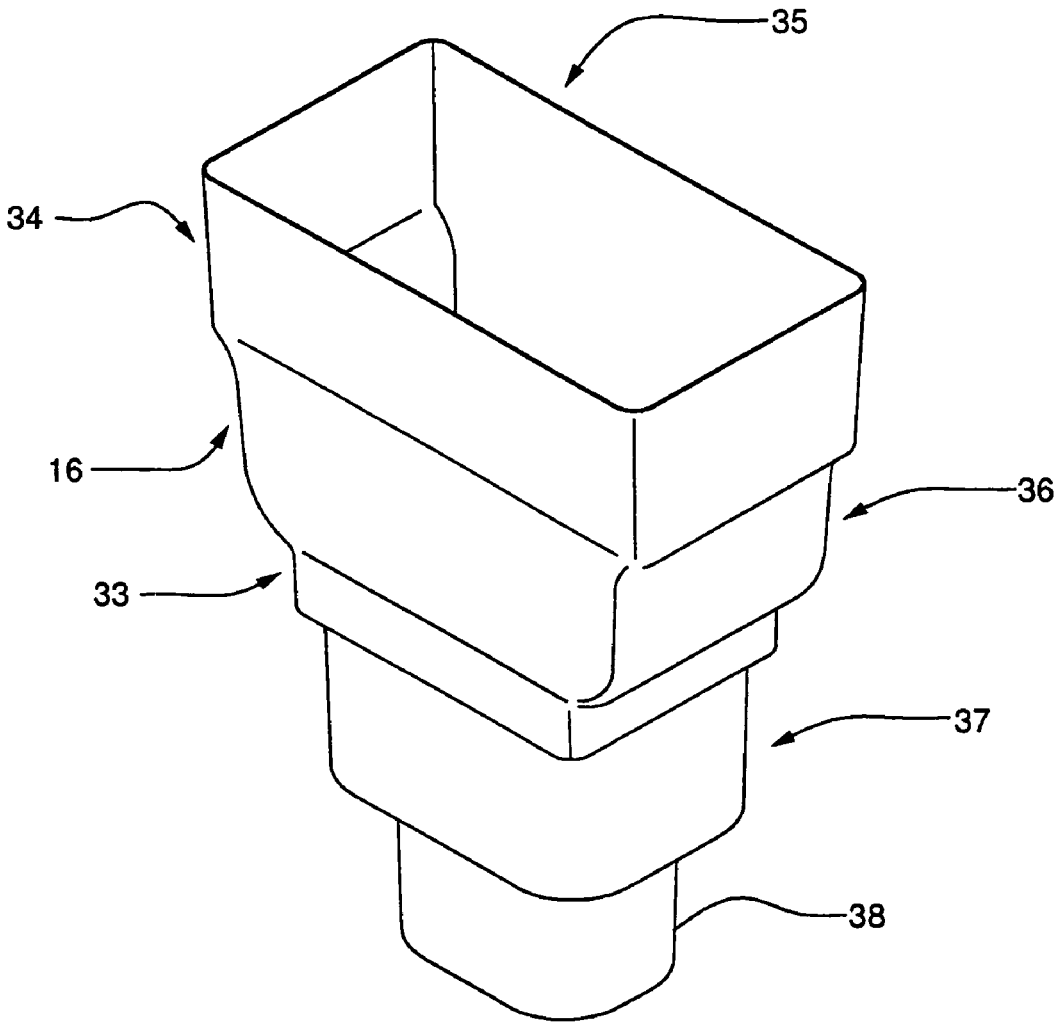
FIG. 5 is an enlarged, isometric view showing the box of the removable downspout system.

FIG. 5 shows a preferred embodiment of the box 16, once again, separate from the downspout 5 which receives it. The body 33 of the box 16 includes upper portions 34 which define an opening 35 for communicating with the spout 15, and which are substantially rectangular in overall cross-section. Intermediate portions 36 of the box 16 communicate with the upper portions 34, and are provided with a contoured, funnel shape which narrows from the upper portions 34 of the box 16, toward lower portions 37 of the box 16 which form a flange 38 for engaging the downspout 5, or ancillary components (e.g., elbows, extensions, etc.) associated with the downspout 5 (depending on the installation to be made). The flange 38 associated with the lower portions 37 of the box 16 can either be configured to directly mate with components of the downspout 5, depending on their configuration, or a standardized flange can be provided for mating with different downspout types using appropriate adapters for mating the standardized flange with the type of downspout to be used. The upper portions 34, the intermediate portions 36 and the lower portions 37 of the body 33 of the box 16 are preferably formed as an integral structure, but can be formed as separate, connected structures, if desired.

Figure 6:
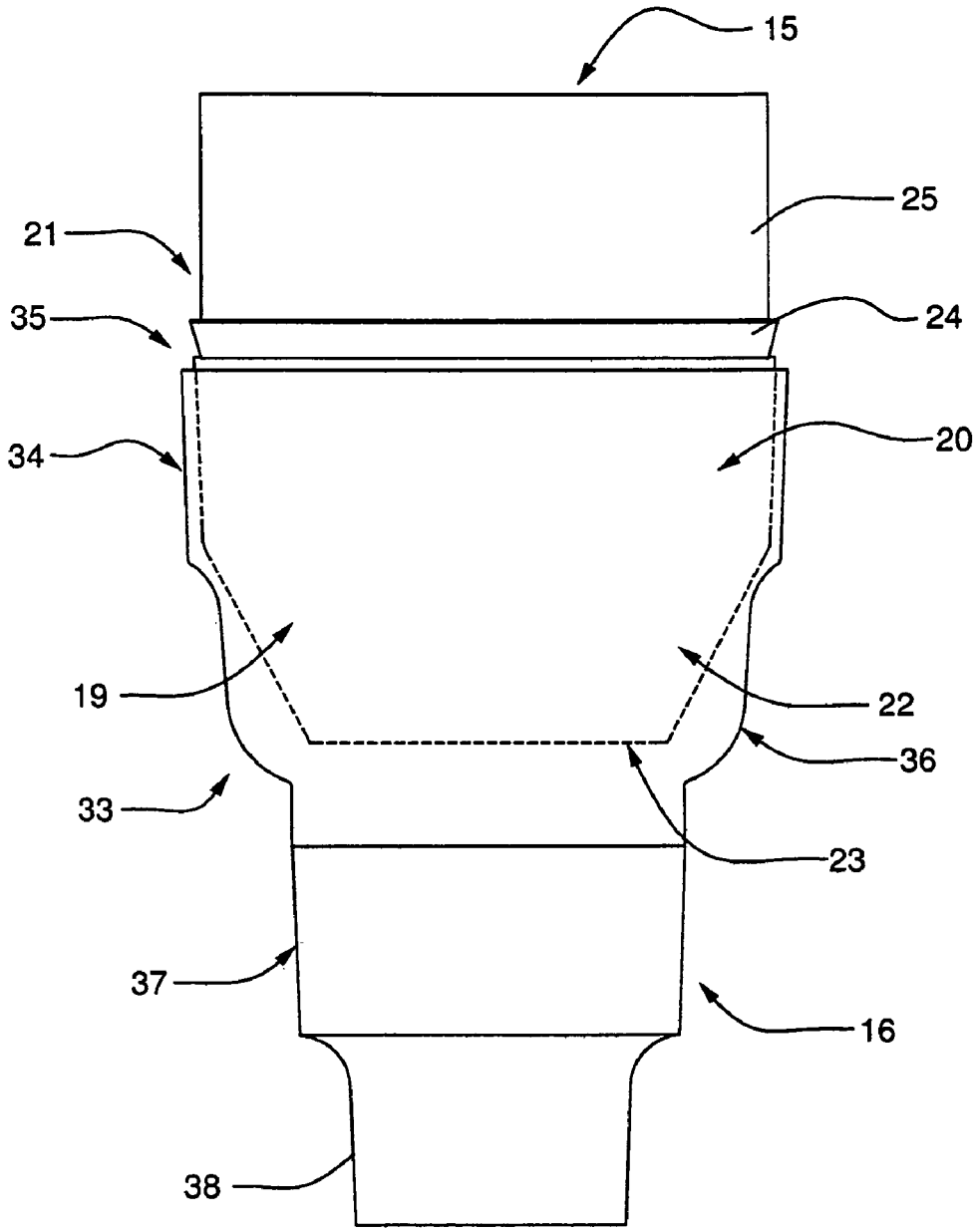
FIG. 6 is an elevational view showing a box mated with a spout, which is partially shown in phantom.

FIG. 6 shows a box 16 which has been positioned over a spout 15, illustrating cooperation between the nested spout 15 and box 16. As is preferred, the upper portions 20 of the spout 15 are correspondingly configured with the upper portions 34 of the box 16 to develop a close, sliding engagement between the two structures. This is preferred to minimize the potential for leakage at this junction. As is also preferred, the lower portions 22 of the spout 15 are tapered to loosely engage the intermediate portions 36 of the box 16. To be noted is that the opening 23 of the spout 15, which is to communicate with the downspout 5, is fully open to the regions below and is raised relative to the lower portions 37 of the box 16. This is preferred to establish a significant vertical drop, and as a result, a free flow of water from the spout 15 to the flange 38 for communicating with the downspout 5, to maximize flow and in turn reduce the potential for debris from collecting in the lower portions 38 of the box 16.

Both the spout 15 and the box 16 are preferably formed of a metal. While aluminum is particularly preferred, copper can also be used, if desired. Various different plastic materials can also be used, although such use is presently considered to be less favorable because plastic materials tend to deteriorate more rapidly than metals when put into service. The spout 15 and the box 16 can be stamped, roll-formed, or molded into their desired shape, depending upon the shape of the component and the material which is used. For metal forms, thicknesses in a range of 0.030 to 0.040 inches are presently considered preferred. Standard gutters and downspouts are generally produced from materials having thicknesses on the order of 0.028 to 0.032 inches. The spout 15 and box 16 are preferably made using heavier materials to reduce the potential for damage to such components resulting from the repeated removals and insertions that will take place in the course of their use. The spout 15 and the box 16 are also preferably powder coated, using processes which are in and of themselves known, to further protect such components, and for improved aesthetic appearance.

Figure 7:
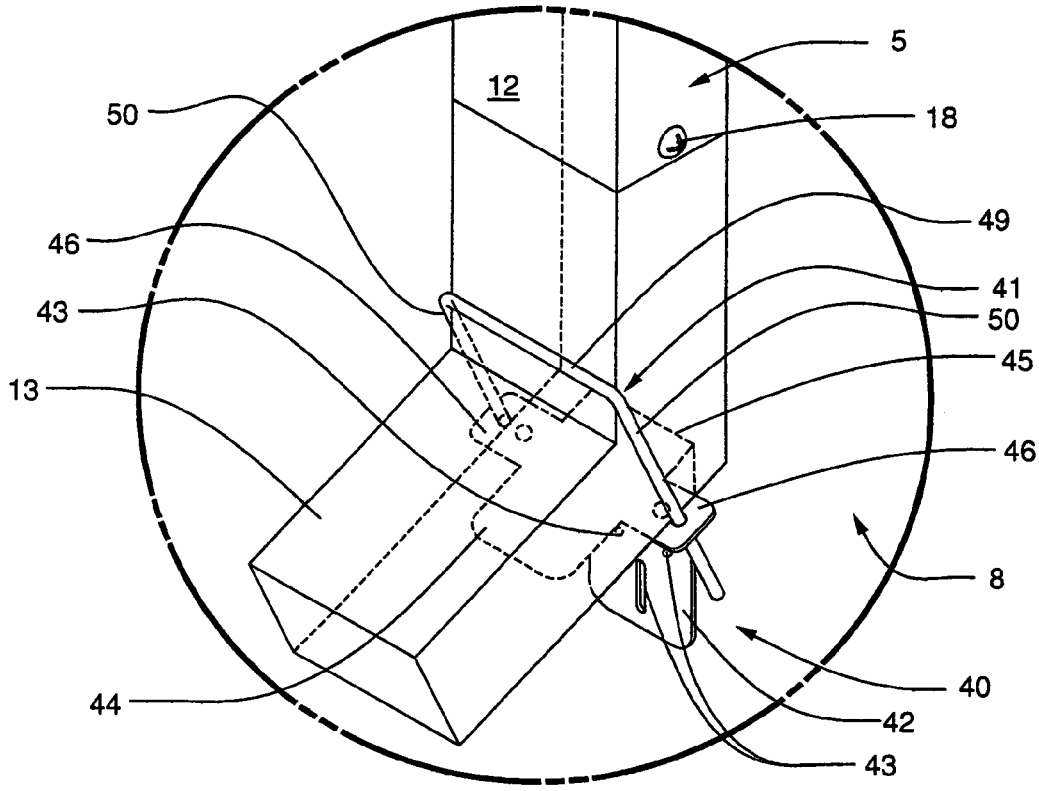
FIG. 7 is an enlarged, isometric view showing lower portions of the removable downspout mated to the base for fixing the downspout to the structure.

FIG. 7 shows the lower portions 12 of the downspout 5 in greater detail, including the shoe 13 which is used to direct water discharged from the downspout 5 away from the structure 1. A base 40 and clip 41 are provided to support the downspout 5, and to retain the downspout 5 in proper position relative to the gutter 4 and the structure 1. To this end, the downspout 5 is preferably supported relative to the gutter 4 so that the spout 15 is fully engaged by and received within the box 16, as shown in FIG. 6. This is preferred to minimize the potential for leakage at this junction, and to provide a secure assembly of components.

Figure 8:
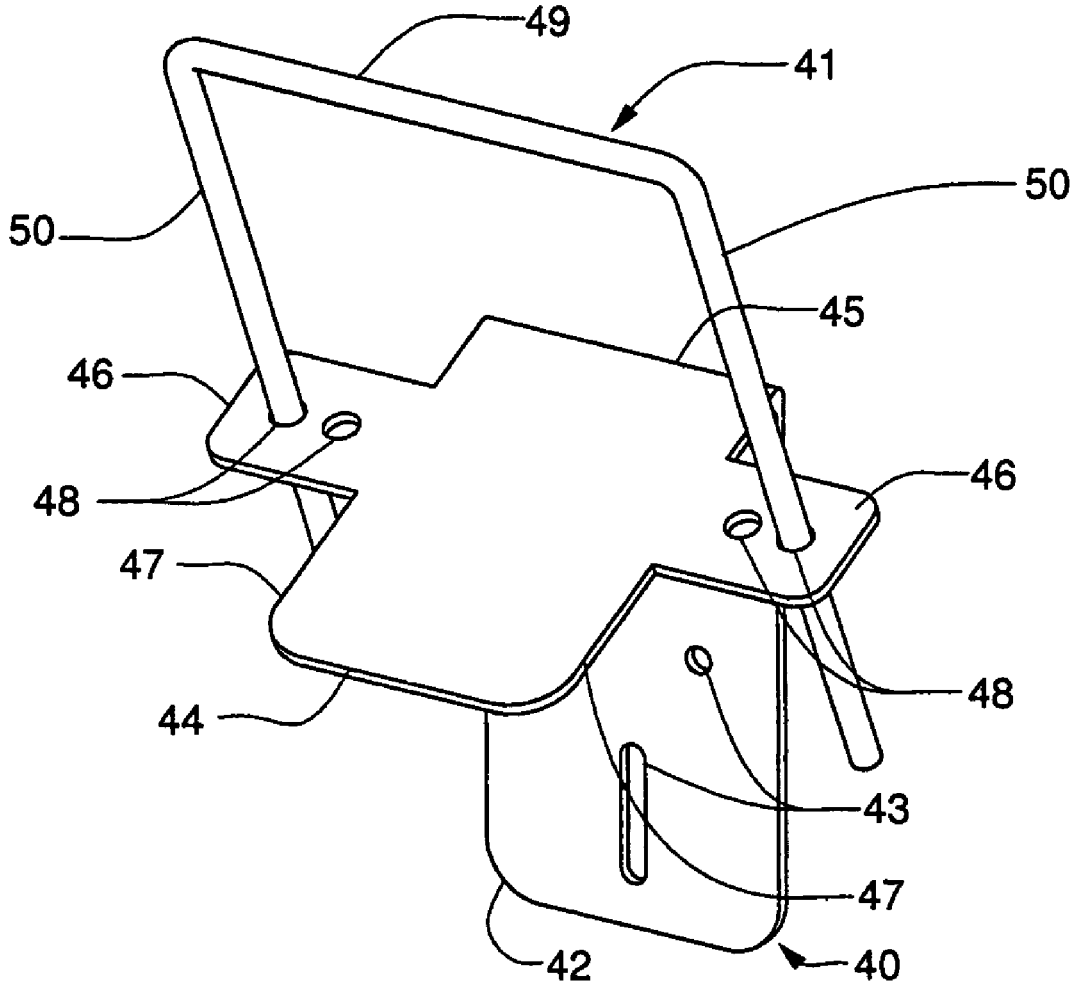
FIG. 8 is an isometric view showing the base, with the attachment clip, and with the downspout removed.

FIG. 8 shows the assembly of FIG. 7, with the downspout 5 removed to better show the structure of the base 40 and the clip 41. The base 40 generally includes a flange 42 having a series of apertures 43, and an angled support surface 44 projecting from a top edge 45 of the flange 42. The apertures 43 are provided to receive hardware which is appropriate for attaching the flange 42 of the base 40 to the wall 8 of the structure 1, as will be discussed more fully below. A pair of flanges 46 extend laterally from opposing side edges 47 of the support surface 44, and include corresponding apertures 48 for receiving the clip 41.

The flanges 46 of the base 40 each preferably include plural, mated pairs of apertures 48, for receiving clips 41 of different sizes. For example, in the configuration shown, the outer pair of apertures 48 would have a separation slightly more than 4 inches, to receive a clip 41 appropriate for engaging a 3×4 inch, A-type downspout, and the inner pair of apertures 48 would have a separation slightly more than 3 inches, to receive a clip 41 appropriate for engaging a 2×3 inch, A-type downspout or a 3×4 inch, B-type downspout. Other spacings for the apertures 48 can also be provided, if desired, either in substitution for the above-described sizes, or as additional paired apertures 48 formed in the paired flanges 46. For example, a pair of apertures 48 spaced apart by slightly more than 2 inches can be provided for accommodating a 2×3 inch, B-type downspout.

Figure 9:
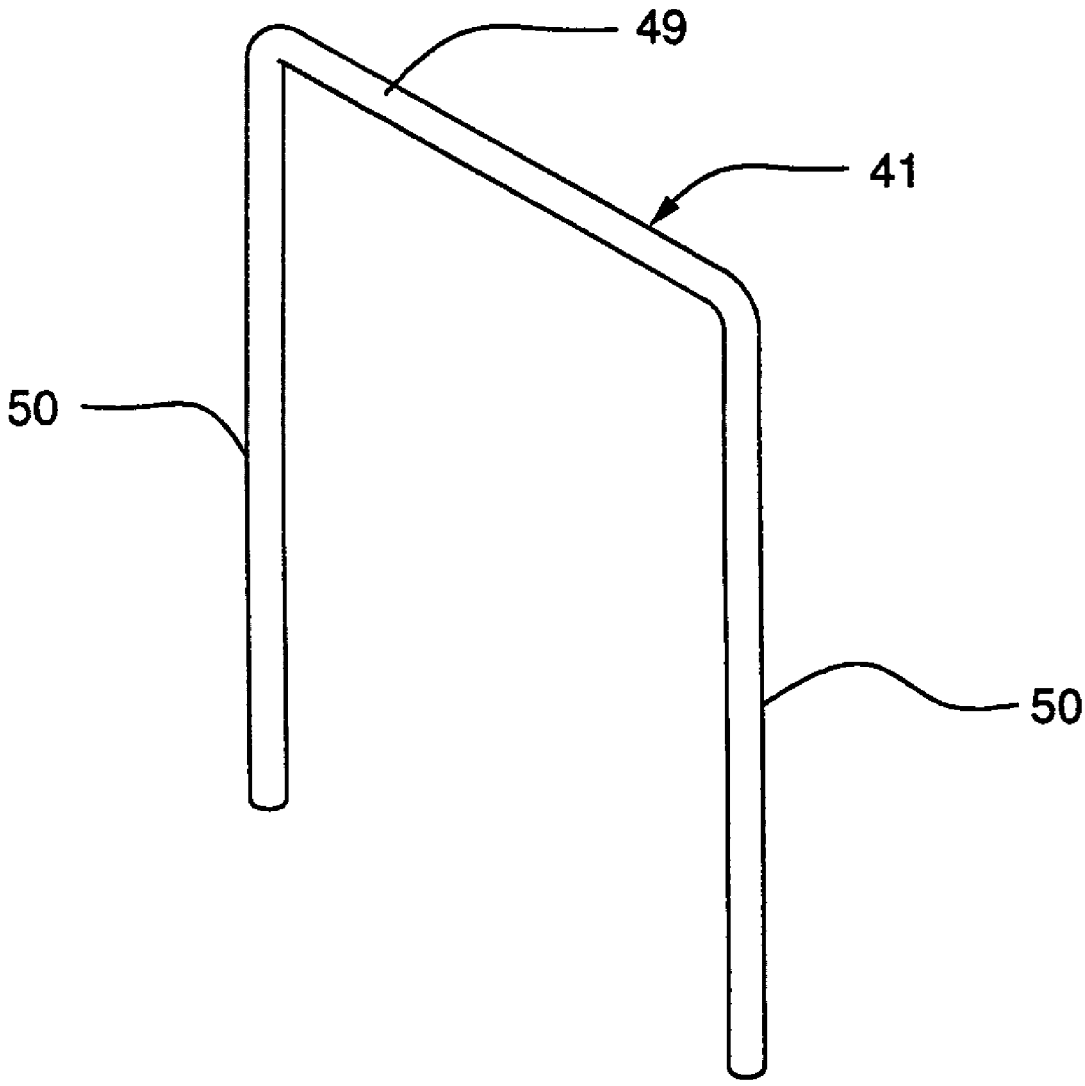
FIG. 9 is an isometric view showing the clip removed from the base.

Referring also to FIG. 9, the clip 41 selected for use with the base 40 will have a retainer 49 with a length which substantially corresponds to the spacing between the apertures 48 appropriate for the installation being implemented, and opposing legs 50 having a length in excess of that needed to engage the apertures 48, for example, several inches in length. Providing the legs 50 with a length in excess of that needed to engage the apertures 48 is preferred to reduce the number of clips 41 that need to be manufactured, so that the desired length can be set in the field, depending on the application required.

The support surface 44 is preferably placed at an angle relative to the flange 42 which is appropriate for receiving the shoe 13 of the downspout 5 so that the shoe squarely rests on the support surface 44. In addition to appropriate placement of the support surface 44 relative to the downspout 5, this also places the flanges 46 and the apertures 48 at an angle which is best for effectively receiving the clip 41. For ease of installation and removal, and for maintaining a secure assembly with the downspout 5 between servicing procedures, the clip 41 is preferably placed at a downwardly sloping angle relative to the base 40 and the downspout 5. A downwardly sloping angle on the order of 60 degrees is presently considered preferred, although other angles (e.g., on the order of 45 degrees) can also be used, if-desired.

Both the base 40 and the clip 41 are preferably formed of a metal. While aluminum is preferred, for durability, the base 44 can also be made from sheet materials such as steel, if desired. The clip 41 is preferably made from rod stock, for example 6061 aluminum rod stock, and preferably has a diameter on the order of 0.250 inches, although increased diameters on the order of 0.375 inches can also be used, if desired. The material used to form the clip 41, and the dimensions for the clip 41, are preferably selected to facilitate installation and removal of the clip 41 from the base 40. To this end, the retainer 49 of the clip 41 is preferably made slightly wider than the spacing of the receiving apertures 48, and the clip 41 is preferably made squeezable for ease in inserting and removing the clip 41. This, coupled with the gravity effects produced by the downwardly sloping angle of the clip 41, facilitates insertion of the legs 50 of the clip 41 into its receiving apertures 48, and removal of the clip 41 from its receiving apertures 48 by squeezing and pulling on the clip 41. Various different plastic materials can also be used, although such use is presently considered to be less favorable because plastic materials tend to deteriorate more rapidly than metals when put into service, and tend to be less resilient, leading to a shorter service life.

FIGS. 7 to 9 illustrate lower portions 12 of the downspout 5 having a shoe 13 for directing water discharged from the downspout 5 away from the structure 1. Another conventional configuration for directing draining water away from a structure 1 is to discharge the water into an underground system of pipe.

Figure 10:
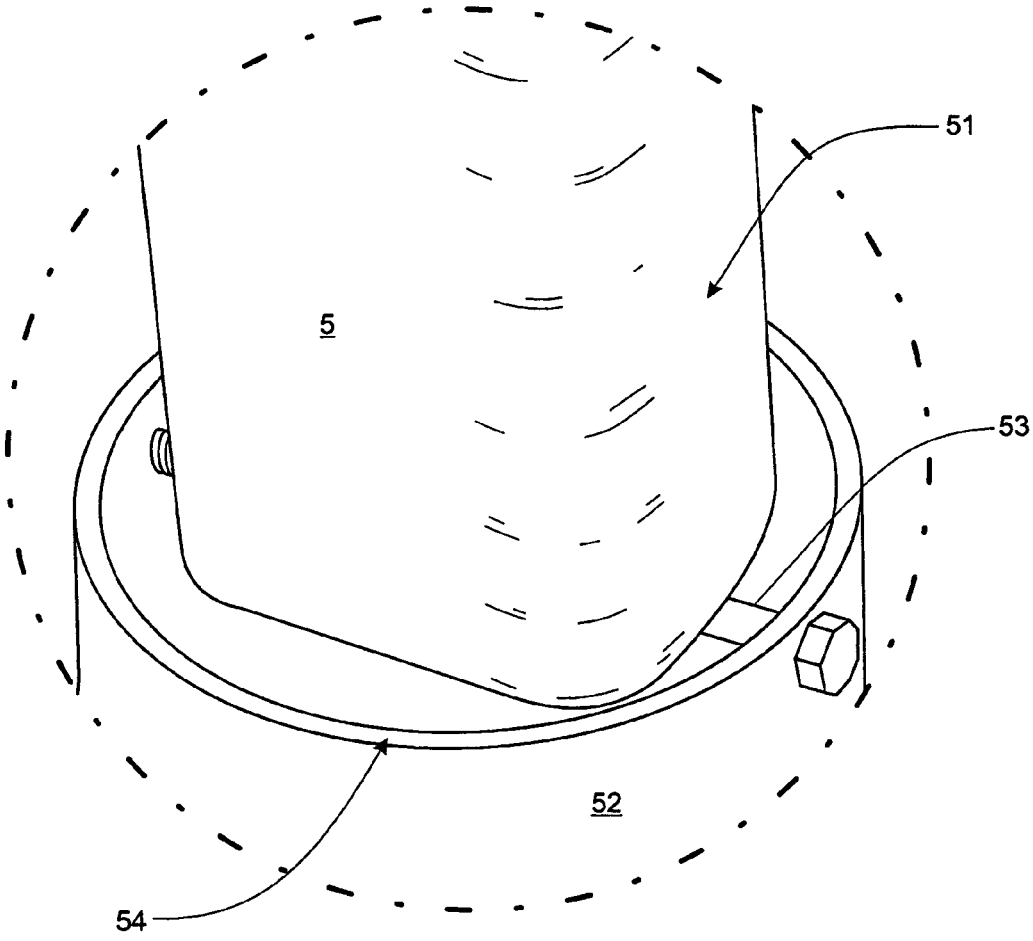
FIG. 10 is an enlarged, isometric view showing lower portions of the removable downspout mated to an underground pipe for directing water away from the structure.

FIG. 10 shows the lower portions 12 of a downspout 5 adapted for discharging water into an underground system of pipe. In this configuration, the lower end 51 of the downspout 5 is caused to communicate directly with a collector 52 which forms the entrance to the underground system of pipe (not further shown). A support structure 53 is placed across the opening 54 of the collector 52, which serves to support the downspout 5, and to retain the downspout 5 in proper position relative to the gutter 4 and the structure 1. To this end, the downspout 5 is preferably supported relative to the gutter 4 so that the spout 15 is substantially engaged by and received within the box 16, to minimize the potential for leakage at this junction, and to provide a secure assembly of components.

In the configuration shown, the support structure 53 is a lag bolt (coupled with an appropriate nut) which has been positioned horizontally through and completely across the opening 54 of the collector 52, and which can then receive and support the lower end 51 of the downspout 5 in desired position. While a single support structure, such as the illustrated lag bolt, is preferred to minimize structures that could catch debris and clog, other support structures can also be used to achieve a similar function, such as a cage or "spider" located over the opening 54, if desired.

For downspouts 5 incorporating a shoe 13 for discharge control, the spout 15 is preferably fully engaged by and received within the box 16. As an example, a full 4 inch overlap of such components is presently considered preferred in such cases. For downspouts 5 which discharge water into an underground system of pipe, the spout 15 is preferably substantially but not fully engaged by and received within the box 16. This is preferred to allow the lower end 51 of the downspout 5 to be recessed relative to the opening 54 of the collector 52. Such recessed placement operates to seat and secure the lower end 51 of the downspout 5 within the opening 54 of the collector 52, while allowing sufficient space between the components, including the spout 15 and the box 16, for the lower end 51 of the downspout 5 to be lifted out of the opening 54 of the collector 52 when a servicing procedure is to be performed. A one inch spacing between the opening 54 of the collector 52 and the lower end 51 of the downspout 5, which in turn establishes a one inch differential between the spout 15 and the box 16, should be sufficient for such purposes. In such cases, a 3 inch overlap between the spout 15 and the box 16 is presently considered preferred.

Figure 11:
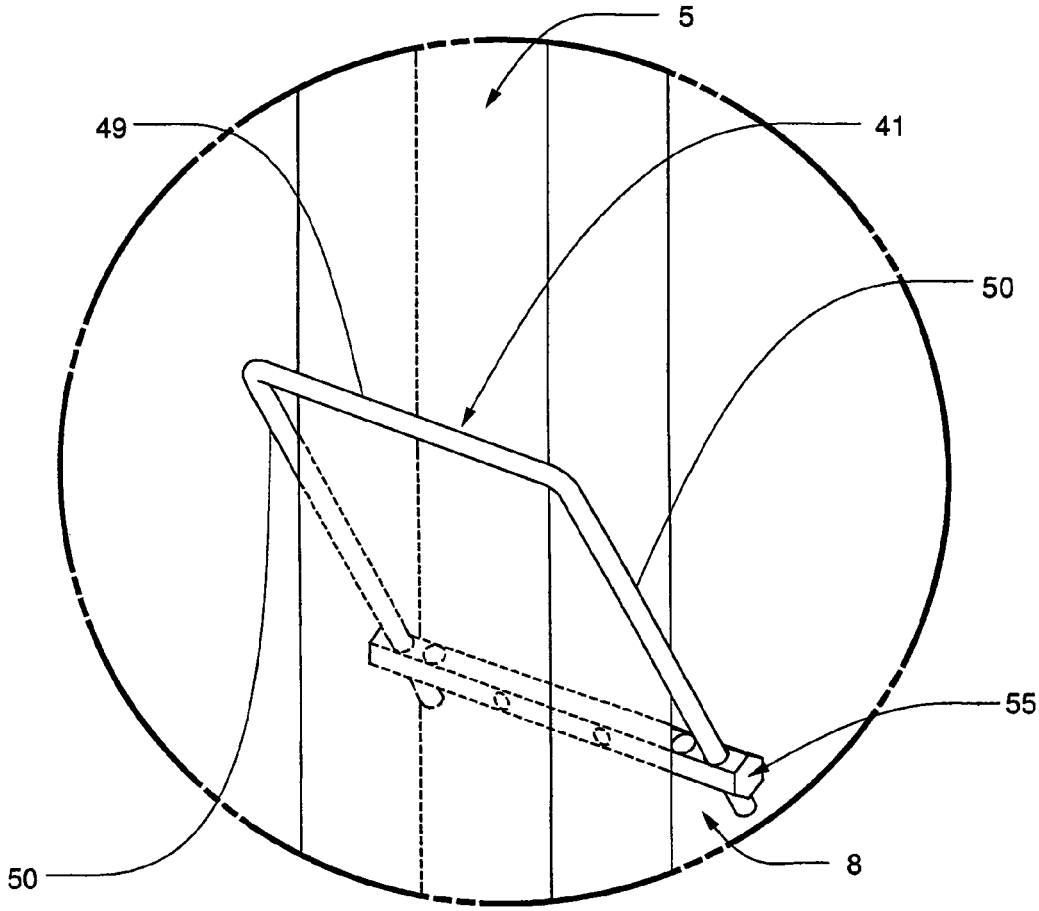
FIG. 11 is an enlarged, isometric view showing mid portions of the removable downspout mated to a clamp for fixing the downspout to the structure.

For many installations, the above-described cooperation between the spout 15 and the box 16, as well as the support for the downspout 5 which is provided by the base 40 of FIGS. 7 to 9 or the support structure 53 of FIG. 10, will be sufficient to securely retain the downspout 5 in desired position on the wall 8 of the structure 1. Some installations may nevertheless require additional support, for example, for use with longer, multi-story downspouts or in cases where significant winds are encountered. FIG. 11 shows one such additional support which can be used in such circumstances.

Figure 12:
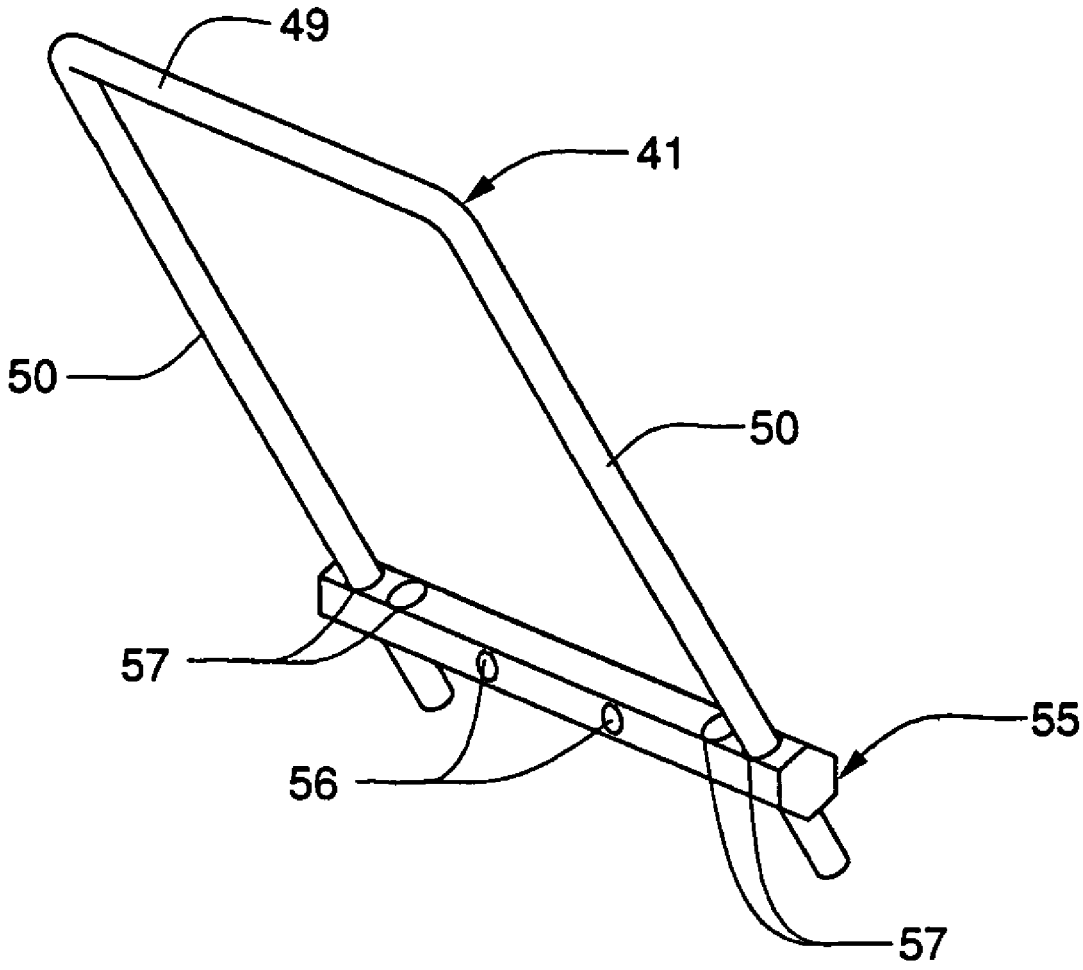
FIG. 12 is an isometric view showing the clamp, with the attachment clip, and with the downspout removed.

FIG. 11 shows intermediate portions of the downspout 5 in greater detail. While mid portions of the downspout 5 have been selected for illustration, similar supports can be placed at any position along the downspout 5, as desired. Illustrated is an additional support 55 for the downspout 5, which will hereafter be referred to as a "clamp", and a clip 41 for cooperating with the clamp 55 to engage the downspout 5. FIG. 12 shows the assembly of FIG. 11 with the downspout 5 removed to better show the structure of the clamp 55 and the clip 41.

The clamp 55 is formed as a generally bar-shaped structure including a first pair of apertures 56, and second paired apertures 57. The apertures 56 are provided to receive hardware which is appropriate for attaching the clamp 55 to the wall 8 of the structure 1. The paired apertures 57 are provided for purposes of receiving the clip 41, which is substantially the same as the clip 41 which is used with the base 40 to retain the lower portions 12 of the downspout 5 in desired position, as previously described.

Plural, paired apertures 57 are preferably provided, again for receiving clips 41 of different sizes. For example, in the configuration shown, the outer pair of apertures 57 would have a separation slightly more than 4 inches, to receive a clip 41 appropriate for engaging a 3×4 inch, A-type downspout, and the inner pair of apertures 57 would have a separation slightly more than 3 inches, to receive a clip 41 appropriate for engaging a 2×3 inch, A-type downspout or a 3×4 inch, B-type downspout. Other spacings for the apertures 57 can also be provided, if desired, either in substitution for the above-described sizes, or as additional paired apertures 57 formed in the clamp 55. For example, a pair of apertures 57 spaced apart by slightly more than 2 inches can be provided for accommodating a 2×3 inch, B-type downspout.

The apertures 57 are preferably placed at an angle that facilitates placement of the clip 41. For ease of installation and removal, and for maintaining a secure assembly with the downspout 5 between servicing procedures, the clip 41 is again preferably placed at a downwardly sloping angle relative to the downspout 5. A downwardly sloping angle on the order of 60 degrees is again considered preferred, although other angles (e.g., on the order of 45 degrees) can also be used, if desired.

The clamp is preferably formed of a metal, with aluminum rod stock being preferred for reasons of durability. Various different plastic materials can also be used, although such use is presently considered to be less favorable because plastic materials tend to deteriorate more rapidly than metals when put into service, and tend to be less resilient, leading to a shorter service life. The clamp 55 can be cut from available bar stock, and preferably has a hexagonal cross-section, although other cross-sectional shapes (e.g., round, square, etc.) can also be used, if desired. A hexagonal cross-section is preferred to place the apertures 56 normal to the wall 8 which is to receive the clamp 55, to facilitate placement of the hardware which is used to secure the clamp 55 to the wall 8, and to place the apertures 57 at the preferred angle of 60 degrees, to facilitate placement of the clip 41.

Installation of the removable downspout system 3 is easily accomplished using the above-described components. For newly installed gutter systems, steps would initially be taken to attach desired gutters 4 to the fascia 7 of the structure 1 using known techniques and following conventional procedures. Proper locations would then be selected for placement of the downspouts 5 which are to communicate with the installed gutters 4. For existing gutter systems, the gutters 4 would already be in place, and the downspouts 5 could either be maintained at their existing locations, or new locations could be used. For existing gutter systems, initial preparation including removal of the existing downspouts and any outlets used for establishing communication between the existing gutters and downspouts would first be required. Irrespective of the overall configuration of the gutter system, the following steps would then be taken for each downspout 5 which is to be made removable.

Figure 13:
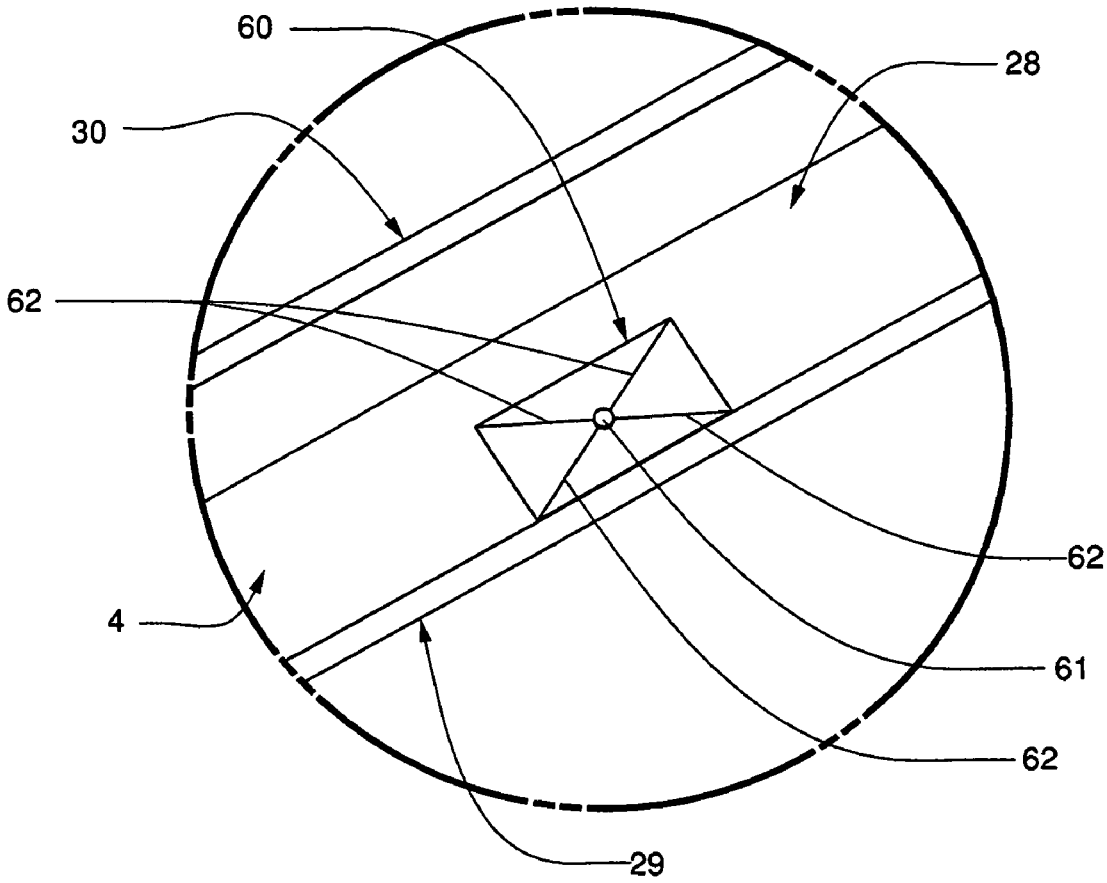
FIG. 13 is an isometric view showing a gutter with a template for preparing the gutter to receive a spout.

Referring to FIG. 13, a template 60 is placed over the bottom 28 of the gutter 4 at the location where the gutter 4 is to communicate with the downspout 5. For this, the template 60 can be positioned on either the inside surface or the outside surface of the gutter 4. A center point 61 is aligned with the desired location for the opening which will communicate with the downspout 5, and cut lines 62 are provided for use in preparing the bottom 28 of the gutter 4 to receive a spout 15. The cut lines 62 preferably form an "X", which is centered about the point 61.

Figure 14:
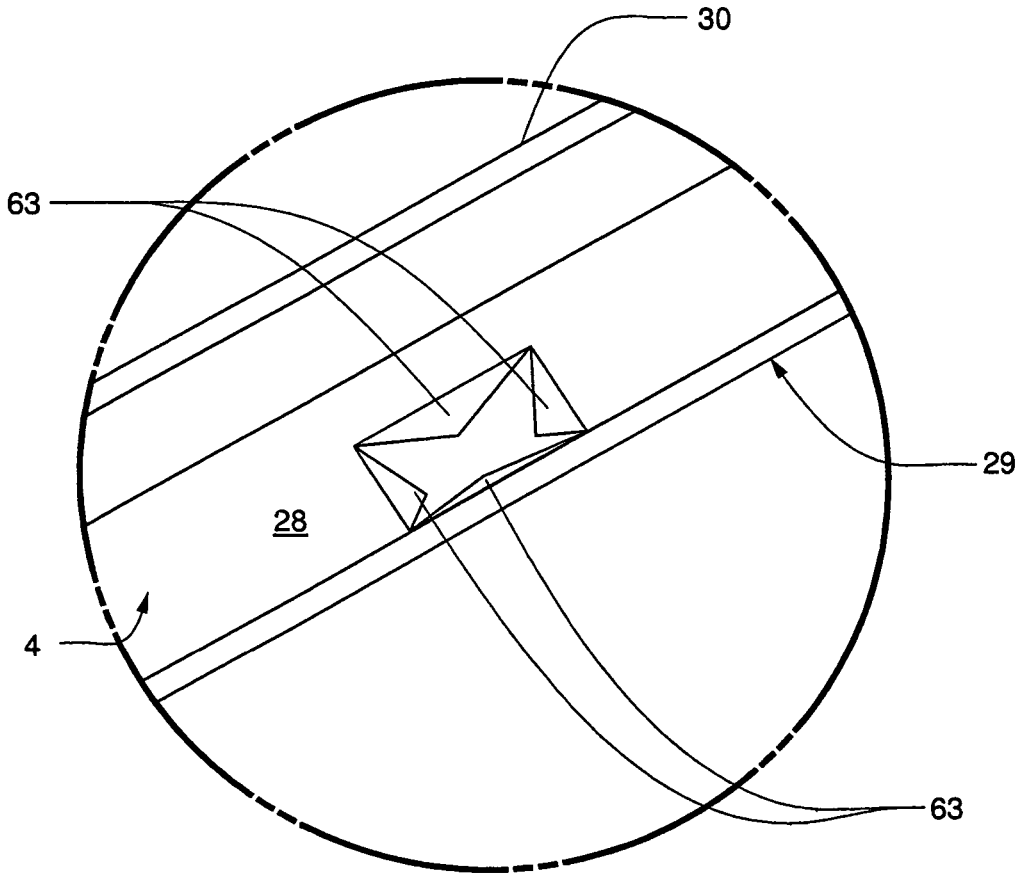
FIG. 14 is an isometric view showing the gutter of FIG. 13 after the bottom of the gutter has been prepared using the template.

Suitable cuts are then made along the cut lines 62 of the template 60, and the resulting sections 63 are then bent down and away from the interior of the gutter 4. Referring to FIG. 14, and for the preferred X-shaped cut lines 62, a series of four V-shaped sections 63 depending from the bottom 28 of the gutter 4 will be produced. The cuts only need to be made in the bottom 28 of the gutter 4, eliminating the need to cut the visible, front portions of the gutter, and improving the overall appearance of the gutter 4 (which remains virtually unchanged).

As is best shown in FIG. 3, the spout 15 is then positioned over the V-shaped sections 63, placing the V-shaped sections 63 inside the spout 15, and is snugly fit over the bottom 28 of the gutter 4. This then places the flange 24 adjacent to the lower side wall portions 29 of the gutter 4, while simultaneously placing the flange 25 between the gutter 4 and the fascia 7. Zip screws 18 can then be inserted through the flange 24, securing the front of the spout 15 to the gutter 4. Suitable roofing hardware can be used to secure the gutter 4 and the rear of the spout 15 to the fascia board 7.

The foregoing procedures are easily performed, and have the additional advantage of eliminating the need for the outlet which is used to connect conventional gutters and downspouts. Such outlets are traditionally inserted into a hole created in the gutter and leading to the downspout, and are designed with a collar or lip which can be used to seat the outlet over the hole in the gutter. Such lips have, in practice, been found to create a raised ridge between the gutter and the outlet hole which can catch and stop debris before reaching the opening in the outlet. This then tends to prevent other debris from moving down the gutter, leading to clogging of the outlet hole, which is further complicated by the relatively small holes which are traditionally provided in such gutters. As a result, it becomes easy for debris to become trapped near the outlet holes, leading to easy and frequent clogging.

The screws and rivets that are traditionally used to secure the outlet to the gutter also tend to present certain disadvantages. Such fasteners can further trap debris moving down the gutter, and over time, can rust. The holes drilled through the lip of the outlet and the gutter, for receiving the attachment hardware can, over time, also rust and leak.

Such problems are overcome by eliminating the raised features associated with the outlets which were previously in common use, in favor of a smooth, flat and rimless transition, and by significantly increasing the size of the drain opening. The gutter 4 is simply cut and bent downwardly, and the enlarged opening that results serves to enhance the flow of water and debris from the gutter 4 to the downspout 5 because there is no encumbrance to the debris or to slow the flow of water. In practice, water tends to accelerate at the transition between the gutter 4 and the downspout 5 because the water flows directly from the gutter 4 and into the downspout 5 and because of the clear, vertical drop from the gutter 4 to the box 16 and the associated downspout 5. In addition to eliminating the need for water and debris to flow up and over the interfering rim of the outlet, elimination of the outlet also operates to eliminate the screws and rivets which were used to secure the outlet to the gutter, further improving overall flow and service life. The need for screws, rivets, and the holes for receiving them, for connecting and supporting other components of the downspout system, is further eliminated by use of the clips 41.

Figure 15:
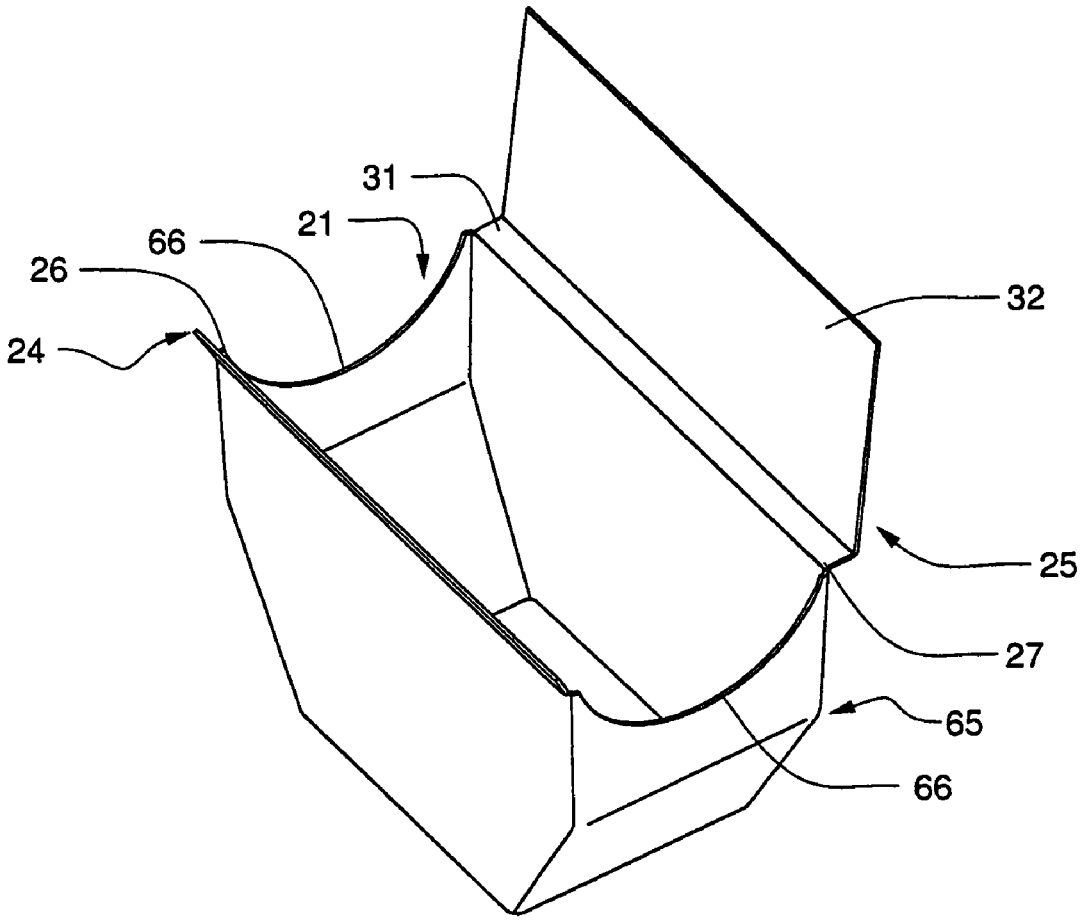
FIG. 15 is an isometric view showing a spout for use with half-round gutters.
Figure 16:
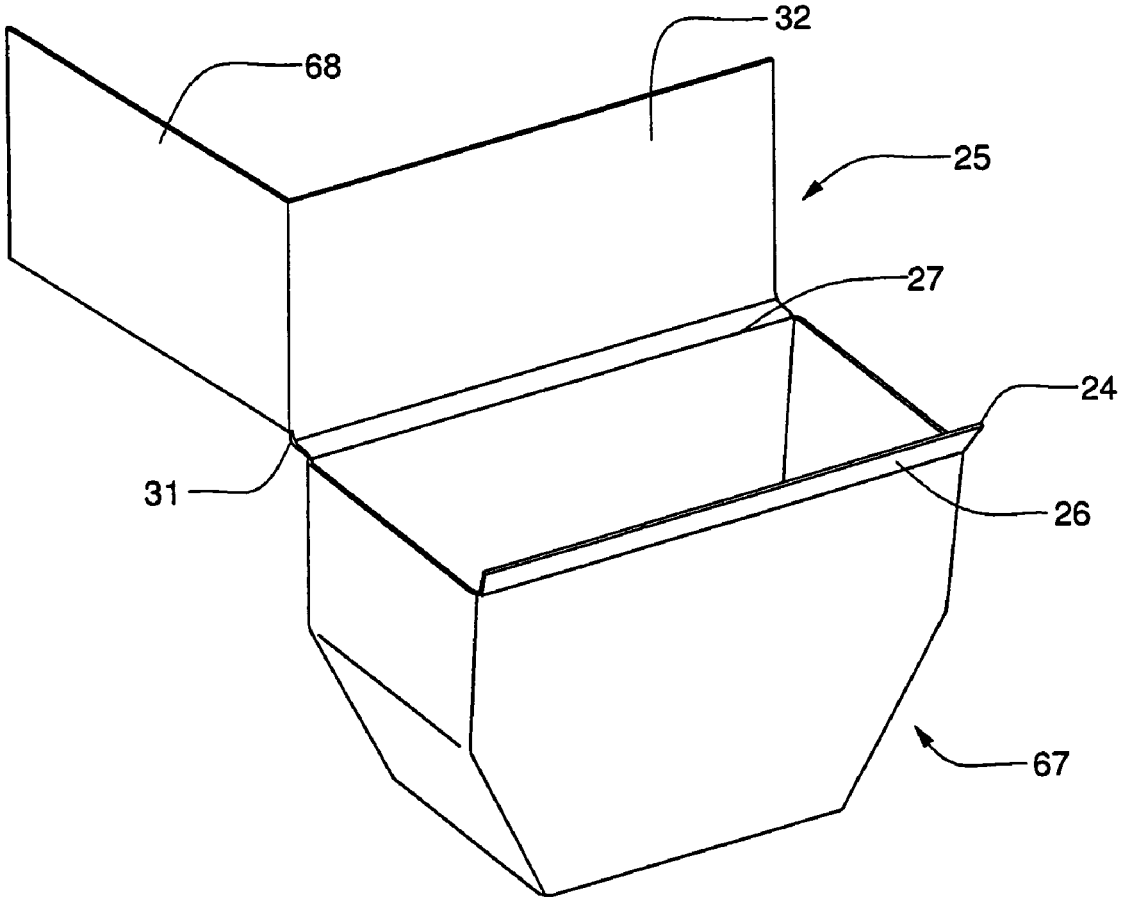
FIG. 16 is an isometric view showing a spout for use in corner applications.

Variations of the spout 15 are possible for purposes of meeting the specifications required for different installations. For example, FIG. 15 shows a spout 65 which can be used to mate with a half-round gutter. To this end, the straight edges of the spout 15 are replaced with curved side edges 66, for conforming to the bottom surface of a half-round gutter. Additional cuts may need to be formed in the bottom of the half-round gutter to facilitate folding of the gutter material. FIG. 16 shows a spout 67 which can be used to develop an outside corner for the gutter system. To this end, an extension 68 is added to the planar flange 25 of the spout 15. An inside corner can similarly be developed by reversing the bend of the extension 68, and left and right corner pieces can be developed by providing extensions 68 formed as mirror image structures relative to the flange 25.

Referring to FIG. 2, installation of the removable downspout system 3 continues with mating of the box 16 with the downspout 5. In the configuration shown, the box 16 is mated with the elbow 11 ahead of the extension 10. To this end, the flange 38 of the box 16 (or an adapter, if used) is inserted into the opening of the elbow 11, and the assembly is joined together using, for example, zip screws 18. For applications where no extension is needed, the box 16 can be inserted directly into the downspout 5, and fastened together with the zip screws 18. To be noted is that for purposes of cutting new components to size, steps should be taken to account for the drop of the box 16 as part of any measurements to be taken (e.g., if an extension 10 is used, or to size the downspout 5).

Referring to FIGS. 7 and 8, the base 40 is located on the wall 8, along the centerline for the downspout 5. The base 40 is preferably installed at least 1 foot up from ground level, for ease of subsequent use, and for facilitating the acceptance of suitable extensions for directing discharged water away from the structure (preferably, for a distance of at least 5 feet). To this end, and following sizing of the downspout 5, the base 40 is connected to the wall 8 of the structure 1 using appropriate hardware (e.g., screws, etc.). The vertical positioning of the base 40 is preferably adjusted so that the shoe 13 at the bottom of the downspout 5 will rest on the base 40, and so that there is a snug vertical fit. One of the apertures 43 is preferably slotted to facilitate such adjustment. Following adjustment, additional hardware can be used to securely attach the base 40 to the wall 8 through additional apertures 43. The box 16 is then inserted over the spout 15, and the downspout 5 is caused to rest snugly on the support surface 44 of the base 40. The clip 41, which can be trimmed to size, as needed, by cutting the legs 50 to their desired length, is positioned over the downspout 5 and/or the shoe 13. To this end, the legs 50 are inserted into the appropriate apertures 48 of the base 40, for securing the downspout 5 in desired position, and for completing installation of the downspout 5.

For applications where additional support of the downspout 5 is needed, the clamp 55 can be positioned along the wall 8, in general alignment with the downspout 5, and can be fixed to the wall 8 using conventional hardware. Placement of the clamp 55 behind the downspout 5, and about 5 to 6 feet up from the ground, is generally preferred to facilitate access to the clip 41 associated with the clamp 55, and will be sufficient to provide support for extended downspouts having a significant length. The clip 41 is then trimmed to size, by cutting the legs 50 to their desired length, and is positioned over the downspout 5 and the clamp 55. To this end, the legs 50 are inserted into the appropriate apertures 57 of the clamp 55, to secure the downspout 5 in desired position.

Referring to FIG. 10, rather than using the base 40, as previously described, the downspout 5 is sized to interface with the collector 52 which communicates with an underground system of pipe by resting on the support structure 53. To this end, the downspout 5 is preferably sized to allow approximately 1 inch of play to help prevent water from overflowing and exiting from the collector 52. This, in turn, leaves 1 inch of play where the box 16 meets the spout 15, so the downspout 5 can be lifted up and out of the collector 52 when servicing is desired. Thereafter, the box 16 is inserted over the spout 15, and the downspout 5 is caused to rest on the support structure 53. In such applications, an additional support such as the clamp 55 is preferably installed as previously described, to secure the downspout 5 to the structure 1, and to complete the installation of the downspout 5.

Figure 17:
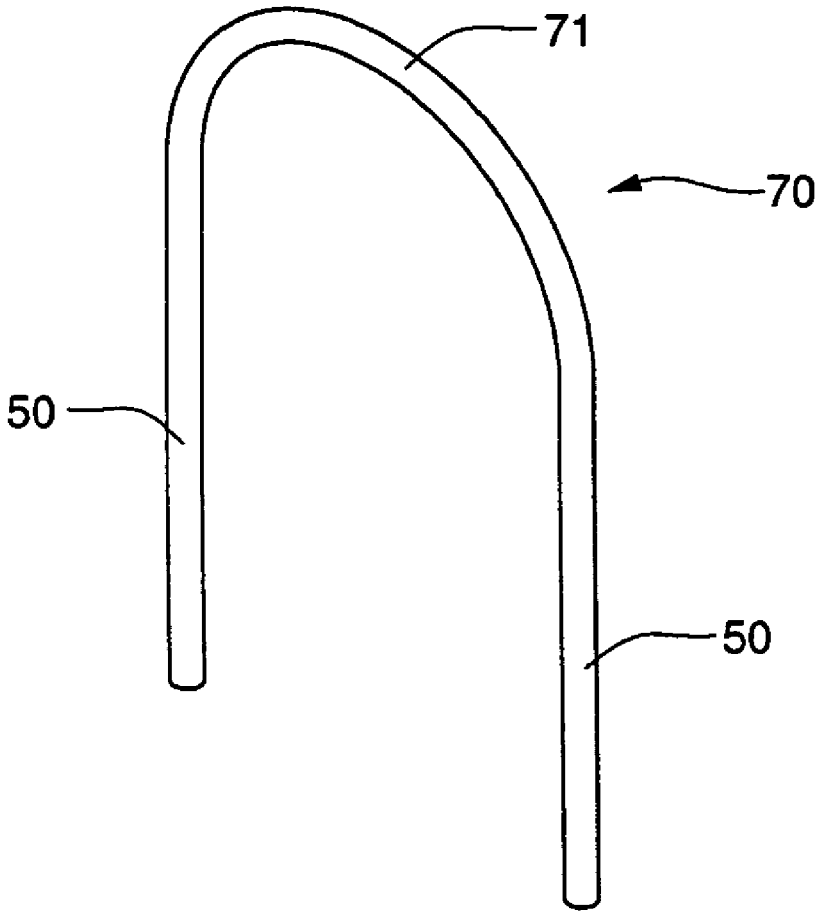
FIG. 17 is an isometric view showing a clip for use with round downspouts.
Figure 18:
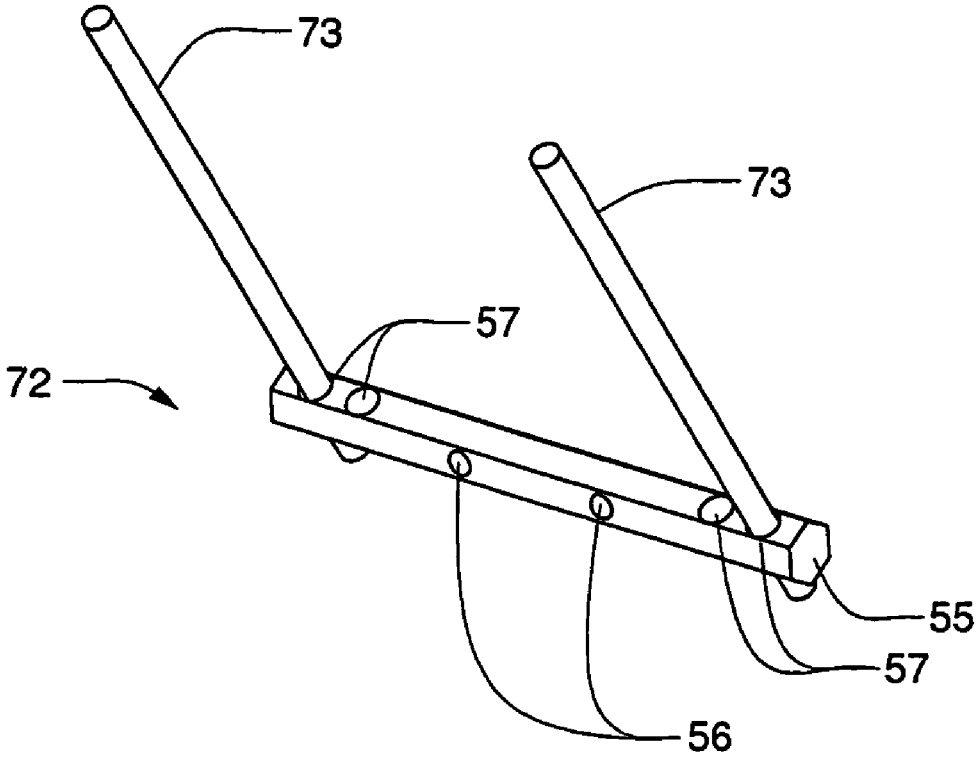
FIG. 18 is an isometric view showing a downspout stabilizing assembly.

Each of the previously described installations make use of rectangular downspouts 5, and for this reason, employ squared clips 41. FIG. 17 shows a clip 70 having a rounded outer face 71, which can be used for engaging round downspouts. FIG. 18 shows a downspout stabilizing assembly 72, which can also be used to provide a downspout with additional (lateral) support. The downspout stabilizing assembly 72 includes a clamp 55, which is substantially the same as the clamp 55 previously described, mated with an opposing pair of grips 73. The grips 73 can be cut from rod stock, and are caused to engage the apertures 57 of the clamp 55. A downspout (rectangular, round, etc.) can then be placed between the grips 73, providing lateral support for the downspout.

Irrespective of the specific installation, the removable downspout system 3 can be easily removed from the structure 1 by removing the clip(s) 41 from the base 40 and/or the clamp(s) 55, and by removing the released downspout 5 from the structure 1. The downspout 5, including the box 16, can then be cleaned while on the ground, and replaced by reversing the procedures used for removing the downspout 5 from the structure 1. The gutter 4 can similarly be inspected from the ground, even for covered gutter installations. For downspouts 5 that communicate with a system of underground pipe, removal of the downspout 5 and the support structure 53 also allows the underground pipe to easily be checked for clogging debris, and flushed out, as needed, and placement of the support structure 53 across the opening 54 of the collector 52 tends to keep larger debris (e.g., balls, bee hives, etc.) out of the underground pipe system.

When assembled, the spout 15 and the box 16 cooperate to prevent water from leaking at the resulting junction, even in hard rains, because of the enhanced overlap between the two components. The enlarged water-collecting region defined by the spout 15 and the box 16 and the taper of the box 16 from a wider opening along its upper portions 34 to a narrower opening in its lower portions 37 tend to promote acceleration of the draining water and a resulting flushing effect capable of facilitating the movement of debris through the downspout 5 that would otherwise tend to clog a conventional drainage system.

It will be understood that various changes in the details, materials and arrangement of parts which have been herein described and illustrated in order to explain the nature of this invention may be made by those skilled in the art within the principle and scope of the invention as expressed in the following claims. This includes variations to the foregoing components for purposes of accommodating gutter and downspout sizes and shapes other than those specifically illustrated and described herein.

What is claimed is:

1. A removable downspout system for mating a downspout and a gutter coupled with a structure, the removable downspout system comprising:

a spout forming an enclosure for receiving water collected in the gutter and having an upper opening for communicating with the gutter and a lower opening for discharging the water received by the spout, wherein the upper opening of the spout and bottom portions of the gutter are mated by a connection between the bottom portions of the gutter and the upper opening of the spout without raised features in the bottom portions of the gutter; and a box forming an enclosure for receiving water from the lower opening of the spout and having an upper opening for engaging the spout and a lower opening for discharging the water received by the box, wherein the box is mated with the downspout for receiving the water from the box, and wherein the downspout is disengageably mated with the structure;

wherein the box slidingly engages the spout so that the spout is received within the box and so that the spout is nested within the box for preventing leakage between the spout and the box, wherein the box is disengaged from the spout when the downspout is disengaged from the structure and wherein upper portions of the spout are slidingly engaged by and are nested within upper portions of the box, and wherein lower portions of the spout are loosely engaged by funnel shaped lower portions of the box.

2. The removable downspout system of claim 1 wherein the upper portions of the spout are correspondingly configured with the upper portions of the box.

3. The removable downspout system of claim 2 wherein the lower opening of the spout is fully, open to the box; and is raised relative to the lower opening of the box, for maximizing water flow.

4. The removable downspout system of claim 1 wherein the bottom portions of the gutter include an opening formed as a plurality of segments, and wherein the plurality of segments are folded downwardly and engage the upper opening of the spout.

5. The removable downspout system of claim 1 wherein the spout includes body portions forming the enclosure of the spout, and wherein the body portions of the spout include upper portions which define the upper opening of the spout, and lower portions in communication with the upper portions of the spout.

6. The removable downspout system of claim 5 wherein the upper portions of the spout are substantially rectangular in cross-section.

7. The removable downspout system of claim 6 wherein the lower portions of the spout have inwardly disposed, tapered walls.

8. The removable downspout system of claim 7 wherein the tapered walls of the lower portions of the spout form an inverted, truncated, substantially pyramid shaped section which defines the lower opening of the spout.

9. The removable downspout system of claim 8 wherein the box includes body portions forming the enclosure of the box, and wherein the body portions of the box include upper portions which are substantially rectangular in cross-section and which define the upper opening of the box, and substantially funnel shaped portions in communication with the upper portions of the box.

10. The removable downspout system of claim 9 wherein the upper portions of the spout are slidingly engaged by and are nested within the upper portions of the box, and wherein the lower portions of the spout are loosely engaged by the funnel shaped portions of the box.

11. The removable downspout system of claim 10 wherein the upper portions of the spout are correspondingly configured with the upper portions of the box.

12. The removable downspout system of claim 10 wherein the lower opening of the spout is fully open to the box, and is raised relative to the lower opening of the box, for maximizing water flow.

13. The removable downspout system of claim 6 wherein the upper portions of the spout include front edge portions having a mounting flange.

14. The removable downspout system of claim 6 wherein the upper portions of the spout include rear edge portions having a mounting flange.

15. The removable downspout system of claim 14 wherein the mounting flange associated with the rear edge portions of the spout includes a first, substantially horizontal section projecting outwardly and away from the rear edge portions of the spout, and a second, substantially vertical section projecting from the first, substantially horizontal section.

16. The removable downspout system of claim 15 wherein the spout is a corner unit, and wherein the corner unit further includes an extension coupled with a lateral edge of the flange and forming an angle with the flange.

17. The removable downspout system of claim 6 wherein the bottom portions of the gutter have a width, and wherein the upper opening of the spout has a width which substantially corresponds to the width of the bottom portions of the gutter.

18. The removable downspout system of claim 1 wherein the box includes body portions forming the enclosure of the box, and wherein the body portions of the box include upper portions which define the upper opening of the box, and lower portions in communication with the upper portions of the box.

19. The removable downspout system of claim 18 wherein the upper portions of the box are substantially rectangular in cross-section.

20. The removable downspout system of claim 19 wherein the lower portions of the box have narrowing, contoured, funnel shaped walls which narrow from the upper portions of the box toward lower portions of the box which form a flange for engaging the downspout.

21. The removable downspout system of claim 20 which further includes an adapter for mating the flange of the box with the downspout.

22. The removable downspout system of claim 20 which further includes an ancillary component for mating the flange of the box with the downspout.

23. The removable downspout system of claim 22 wherein the ancillary component is an elbow associated with the downspout.

24. The removable downspout system of claim 1 wherein the gutter is a K-type gutter.

25. The removable downspout system of claim 1 which further includes a base for disengageably supporting lower portions of the downspout.

26. The removable downspout system of claim 25 wherein the base engages a shoe mated with the lower portions of the downspout.

27. The removable downspout system of claim 25 wherein the base engages the lower portions of the downspout so that the spout is fully engaged by and received within the box.

28. The removable downspout system of claim 25 wherein the base includes a flange having apertures for attaching the base to the structure, and an angled support surface projecting from a top edge of the flange.

29. The removable downspout system of claim 28 wherein the angled support surface includes a plurality of apertures for receiving a clip, wherein the clip combines with the support surface of the base to engage the lower portions of the downspout.

30. The removable downspout system of claim 29 wherein the angled support surface includes plural, paired apertures for receiving clips for engaging downspouts having different sizes.

31. The removable downspout system of claim 29 wherein the apertures are associated with a pair of flanges extending laterally from opposing side edges of the angled support surface.

32. The removable downspout system of claim 29 wherein a spacing is defined between the apertures, and wherein the clip includes a retainer having a length which substantially corresponds to the spacing between the apertures, and opposing legs having a length in excess of a length needed to engage the downspout.

33. The removable downspout system of claim 29 wherein the angled support surface places the clip at a downwardly sloping angle relative to the base, and the downspout.

34. The removable downspout system of claim 33 wherein the downwardly sloping angle is approximately 60 degrees.

35. The removable downspout system of claim 33 wherein the clip has a retainer which is wider than a spacing between the apertures, and the clip is formed of a flexible material.

36. The removable downspout system of claim 1 wherein the downspout is mated with an underground pipe having an opening for receiving water discharged from the downspout, and which further includes a support structure coupled with the opening for disengageably supporting lower portions of the downspout.

37. The removable downspout system of claim 36 wherein the support structure is placed across the opening, for supporting the downspout over the opening.

38. The removable downspout system of claim 36 wherein the support structure engages the lower portions of the downspout so that the spout is substantially but not fully engaged by and received within the box.

39. The removable downspout system of claim 36 wherein the support structure is a bolt positioned horizontally through and completely across the opening.

40. The removable downspout system of claim 1 which further includes an additional support for disengageably supporting intermediate portions of the downspout.

41. The removable downspout system of claim 40 wherein the additional support is a clamp having apertures for attaching the additional support to the structure, and paired apertures for receiving a clip, wherein the clip combines with the additional support to engage the intermediate portions of the downspout.

42. The removable downspout system of claim 41 wherein the additional support includes plural, paired apertures for receiving clips for engaging downspouts having different sizes.

43. The removable downspout system of claim 41 wherein a spacing is defined between the paired apertures, and wherein the clip includes a retainer having a length which substantially corresponds to the spacing between the paired apertures, and opposing legs having a length in excess of a length needed to engage the downspout.

44. The removable downspout system of claim 41 wherein the paired apertures place the clip at a downwardly sloping angle relative to the clamp and the downspout.

45. The removable downspout system of claim 44 wherein the downwardly sloping angle is approximately 60 degrees.

46. The removable downspout system of claim 45 wherein the clamp has a hexagonal cross-section, for placing the clip at the downwardly sloping angle of approximately 60 degrees.

47. The removable downspout system of claim 44 wherein the clip has a retainer which is wider than a spacing between the paired apertures, and the clip is formed of a flexible material.

48. The removable downspout system of claim 1 which further includes a downspout stabilizing assembly for removably engaging the downspout to provide the downspout with lateral support.

49. The removable downspout system of claim 48 wherein the downspout stabilizing assembly includes a clamp having apertures for attaching the downspout stabilizing assembly to the structure, and paired apertures for receiving an opposing pair of grips, wherein the grips surround portions of the downspout for engaging the downspout.

50. A method for installing a removable downspout system for mating a downspout and a gutter coupled with a structure, comprising the steps of:

attaching a spout to the gutter, wherein the spout forms an enclosure for receiving water collected in the gutter and has an upper opening for communicating with the gutter and a lower opening for discharging the water received by the spout;

mating the upper opening of the spout and bottom portions of the gutter with a connection between the bottom portions of the gutter and the upper opening of the spout without raised features in the bottom portions of the gutter;

attaching a box to the downspout, wherein the box forms an enclosure for receiving the water from the lower opening of the spout and has an upper opening for engaging the spout and a lower opening for discharging the water received by the box; and attaching the downspout to the structure so that the downspout is disengageably mated with the structure and mating the box with the spout so that the box slidingly engages the spout and so that the spout is received within the box and is nested within the box for preventing leakage between the spout and the box, so that the box is disengaged from the spout when the downspout is disengaged from the structure; and so that upper portions of the spout are slidingly engaged by and are nested within upper portions of the box, and so that lower portions of the spout are loosely engaged by funnel shaped lower portions of the box.

51. The method of claim 50 which further includes the step of cutting the bottom portions of the gutter, developing plural segments formed from material forming the gutter.

52. The method of claim 51 which further includes the step of applying a template having cut lines for defining the plural segments to the bottom portions of the gutter, prior to the cutting step.

53. The method of claim 52 wherein the template has X-shaped cut lines, and which further includes the step of developing a series of four v-shaped sections depending from the bottom portions of the gutter.

54. The method of claim 51 which further includes the steps of bending the plural segments down and away from interior portions of the gutter, and engaging upper portions of the spout with the plural segments, without developing a raised rim between the upper portions of the spout and the bottom portions of the gutter.

55. The method of claim 51 which further includes the step of positioning the spout over the plural segments, placing the segments inside the enclosure of the spout, and snugly fitting the upper portions of the spout over the bottom portions of the gutter.

56. The method of claim 55 which further includes the step of attaching the spout to the gutter.

57. The method of claim 56 wherein the attaching includes the step of connecting a flange associated with front edge portions of the spout to the gutter.

58. The method of claim 57 wherein the attaching further includes the step of connecting a flange associated with rear edge portions of the spout between the gutter and a fascia for receiving the gutter.

59. The method of claim 50 wherein the attaching of the box to the downspout includes the step of mating the box with an elbow coupled with the downspout.

60. The method of claim 50 which further includes the step of supporting the downspout on the structure so that the spout is received within the box and so that the spout is nested within the box for preventing leakage between the spout and the box.

61. The method of claim 60 which further includes the steps of attaching a base for detachably supporting the downspout on wall portions of the structure, and attaching the downspout to the base using a removable clip.

62. The method of claim 60 which further includes the steps of attaching a clamp for detachably supporting the downspout on wall portions of the structure, and attaching the downspout to the clamp using a removable clip.

63. The method of claim 50 which further includes the step of disengageably supporting the downspout on a support structure associated with an underground system of pipe so that the spout is received within the box and so that the spout is nested within the box for preventing leakage between the spout and the box.

64. The method of claim 63 which further includes the step of attaching the support structure across an opening for the underground system of pipe, below the opening, so that the downspout is received within the opening.

65. The method of claim 64 which further includes the steps of attaching a clamp for detachably supporting the downspout on wall portions of the structure, and attaching the downspout to the clamp using a removable clip.

66. The method of claim 50 which further includes the steps of removing the downspout from the structure and separating the box from the spout, releasing the downspout from the structure.

67. The method of claim 66 which further includes the step of cleaning the downspout while removed from the structure.

68. The method of claim 67 which further includes the step of replacing the downspout on the structure by engaging the spout with the box, and disengageably securing the downspout to the structure.

* * * * *